US005241155A

United States Patent [19]

Koh et al.

[11] Patent Number: 5,241,155

[45] Date of Patent: Aug. 31, 1993

[54] IMAGE FIXING APPARATUS HAVING LINEAR HEAT GENERATING LAYER WITH VARIABLE RESISTANCE DISTRIBUTION

[75] Inventors: Shokyo Koh, Yokohama; Shigeo Kimura, Kanagawa; Atsushi Hosoi, Kawasaki; Masahide Kinoshita, Yokohama; Kensaku Kusaka, Kawasaki; Hiroyuki Adachi, Tokyo, all of Japan

[73] Assignee: Canon Kabushiki Kaisha, Tokyo, Japan

[21] Appl. No.: 751,571

[22] Filed: Aug. 22, 1991

Related U.S. Application Data

[63] Continuation of Ser. No. 440,380, Nov. 22, 1989, abandoned.

[30] Foreign Application Priority Data

Nov. 25, 1988 [JP] Japan ..... 63-297475
Dec. 12, 1988 [JP] Japan ..... 63-313279

[51] Int. Cl.[5] ..... G03G 15/20

[52] U.S. Cl. ..... 219/216; 355/289; 355/290

[58] Field of Search ..... 355/208, 218, 282, 285, 355/289, 290; 219/216, 469

[56] References Cited

U.S. PATENT DOCUMENTS

| | | | |
|---|---|---|---|
| 3,578,797 | 5/1971 | Hodges et al. | 219/388 X |
| 3,810,735 | 5/1974 | Moser | 219/216 X |
| 3,811,828 | 5/1974 | Ohta et al. | 219/216 X |
| 4,009,953 | 3/1977 | Ravizza et al. | 355/290 |
| 4,566,779 | 1/1986 | Coli et al. | 355/212 |
| 4,618,240 | 10/1986 | Sakurai et al. | 355/290 X |
| 4,685,794 | 8/1987 | Watanabe | 355/218 |
| 4,780,742 | 10/1988 | Takahashi et al. | 355/290 |
| 4,801,968 | 1/1989 | Kogure et al. | 219/216 X |
| 4,813,372 | 3/1989 | Kogure et al. | 219/216 X |

FOREIGN PATENT DOCUMENTS

| | | | |
|---|---|---|---|
| 0029825 | 3/1976 | Japan . | |
| 0000641 | 1/1979 | Japan | 355/290 |
| 59-102268 | 6/1984 | Japan . | |
| 59-149385 | 8/1984 | Japan . | |

OTHER PUBLICATIONS

Research Disclosure #17635, Dec. 1978, Breton, Henri E.

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image fixing apparatus includes a heater which is stationary during an image fixing operation, a linear heat generating layer and a film movable in sliding contact with the heater in which a toner image on a recording material is heated by heat from the heater through the film. The heater produces amounts of heat which are different in a direction transverse to a direction of movement of the recording material by varying the resistance distribution of the linear heat generating layer.

12 Claims, 20 Drawing Sheets

IMAGE FIXING APPARATUS HAVING LINEAR HEAT GENERATING LAYER WITH VARIABLE RESISTANCE DISTRIBUTION

This application is a continuation-in-part of application Ser. No. 440,380 filed Nov. 22, 1989, now abandoned.

FIELD OF THE INVENTION AND RELATED ART

The present invention relates to an image fixing apparatus for fixing a toner image on a recording medium, more particularly to an image fixing apparatus for heating and fixing a toner image through a film.

In a widely used image fixing apparatus wherein an unfixed toner image is fixed, the recording medium is passed through a nip formed between a heating roller maintained at a predetermined temperature and a pressing or back-up roller having an elastic layer and press-contacted to the heating roller, the recording medium supporting the unfixed toner image.

The conventional image fixing system of this type requires that the heating roller is always maintained at an optimum temperature to avoid high temperature toner offset and low temperature toner offset, and the tolerable range of the temperature is narrow.

In order to reduce the temperature variation of the heating roller, the thermal capacity thereof is required to be large, with the result of longer warming period. In order to solve this problem, U.S. Pat. No. 3,578,797 and Japanese Patent Application Publication No. 29825/1976 propose that the toner is heated and fused through a web or sheet from a heating roller.

U.S. Ser. No. 206,767 which has been assigned to the assignee of this application proposes an image fixing apparatus using a heater having a linear heat generating layer with very low thermal capacity and using a thin film to fix the toner image, by which the warming period is significantly reduced or eliminated. Since, however, the linear heat generating layer has a very low thermal capacity, the temperature difference occurs, when the fixing operation is continued, between the portion where the heat radiation or transfer is large and the portion where it is small. The temperature difference is remarkable between the portion where the recording medium passes and the portion where the recording medium does not pass, even to such an extent that the film is deformed, or the heat generating layer is fused due to excessive temperature rise in the non-heat-passage portion.

SUMMARY OF THE INVENTION

Accordingly, it is a principal object of the present invention to provide an image fixing apparatus wherein the temperature difference hardly occurs along the length of the heat generating layer.

It is another object of the present invention to provide an image fixing apparatus wherein the temperature rise in the non-sheet-passage portion is prevented.

It is a further object of the present invention to provide an image fixing apparatus wherein the heat generating width of the heater is variable.

It is a yet further object of the present invention to provide an image fixing apparatus using a heat generating layer having distributed electric resistances.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
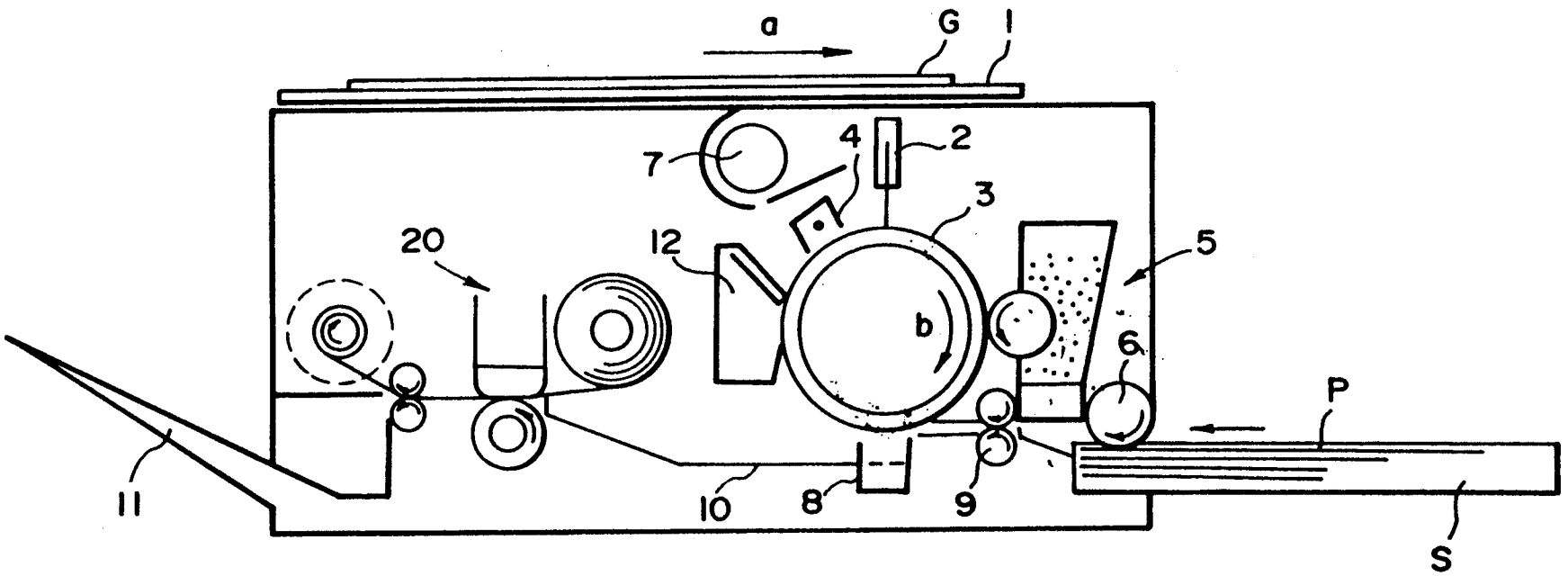
FIG. 1 is a sectional view of an image forming apparatus using an image fixing device according to an embodiment of the present invention.

Referring to the accompanying drawings, the preferred embodiments of the present invention will be described, wherein the like reference numerals are assigned to the elements having the corresponding functions.

FIG. 1 shows a sectional view of an image forming apparatus using an image fixing device according to an embodiment of the present invention. The image forming apparatus comprises an original supporting platen made of transparent material such as glass, which is reciprocable in the directions indicated by an arrow a to scan an original. Right below the original supporting platen 1, there is disposed a short focus small diameter imaging element array 2. An image G of an original placed on the original supporting platen 1 is illuminated by an illumination lamp 7, and the light image provided by the light reflected by the original G is imaged through a slit by the array 2 on a photosensitive drum 3. The photosensitive drum 3 is rotatable in the direction indicated by an arrow b. The apparatus further comprises a charger 4 for uniformly charging the photosensitive drum 3 which is coated with a zinc oxide photosensitive layer or an organic semiconductor photosensitive layer. The photosensitive drum 3 uniformly charged by the charger 4 is exposed to the light image through the array 2, so that an electrostatic latent image is formed thereon. The electrostatic latent image is developed into a visualized image by a developing device 5 with toner particles containing resin material which is softened or fused by heat. On the other hand, a transfer material P which is a sheet-like recording medium accommodated in the cassette S is fed to the photosensitive drum 3 by a pick-up roller 6 and a pair of conveying rollers 9 press-contacted to each other, in timed relation with the image on the photosensitive drum 3. The toner image on the photosensitive drum 3 is transferred onto the transfer material P by a transfer discharger 8. Thereafter, the transfer material P separated from the photosensitive drum 3 by known separating means is conveyed along a conveyance guide 10 into an image fixing apparatus 20, where it is subjected to a heating and fixing operation. Finally, it is discharged to a tray 11. After the toner image is transferred, the toner remaining on the photosensitive drum 3 is removed by a cleaner 12.

Figure 2:
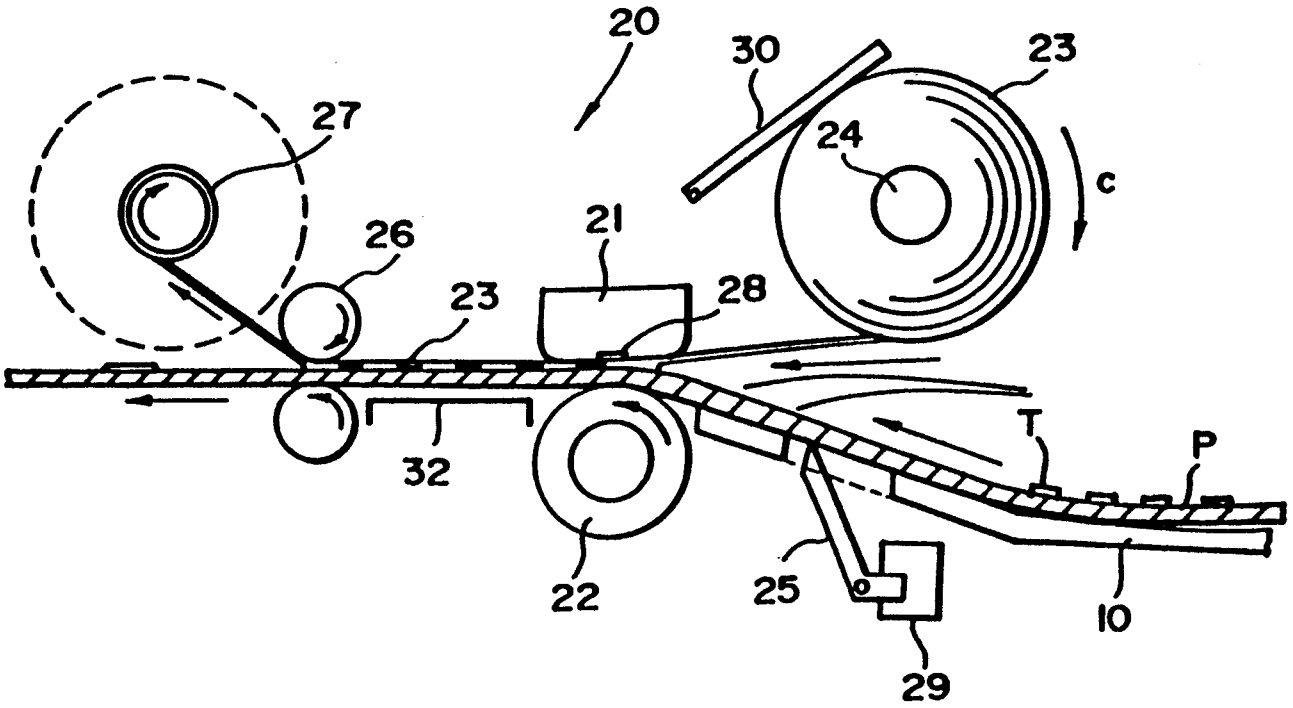
FIG. 2 is an enlarged sectional view of the fixing apparatus according to an embodiment of the present invention.

FIG. 2 is an enlarged sectional view of the image fixing apparatus 20 according to this embodiment. The fixing apparatus 20 comprises a heat generating element 21 including a base member made of electrically insulating and heat-resistive material such as alumina or the like or a compound material containing it, a heat generating layer 28 in the form of a line or a stripe made of $Ta_2N$ or the like and a surface protection layer resistive against sliding, made of $Ta_2O_5$ or the like. The bottom surface of the heat generating element 21 is smooth, and the front and rear portions thereof are rounded to permit smooth sliding of a heat-resistive film 23 functioning as a fixing film. The heat resistive film 23 is made, for example, of PET treated for heat-resistivity having a thickness of approximately 6 microns. It is wound on a film feeding shaft 24. The film is fed out in the direction indicated by an arrow c. The heat resistive film 23 is contacted to the surface of the heat generating element 21 and is taken upon a film take-up shaft 27 by way of a separating roller 26 having a large curvature. Designated by reference numerals 30 and 32 are a heat-resistive sheet sensor and a guide.

The heat generating layer 28 of the heat generating element 21 has a small thermal capacity, and is pulsewisely energized, upon which it is instantaneously heated up to approximately 300° C. each time. The leading and trailing edges of the transfer material P on which the unfixed toner image is formed are detected by a recording sheet detecting lever 25 and a recording sheet detecting sensor 29. In response to the detections, the heat generating layer 28 is energized upon necessity. The energization of the heat generating element 21 may be controlled in accordance with position detection of the transfer material P using a sheet feed sensor of an image forming apparatus with which the image fixing apparatus is used.

On the other hand, the back-up roller 22 includes a core made of metal or the like and an elastic layer made of silicone rubber or the like. It is driven by an unshown driving source and is pressed to the heat generating element 21 through the heat resistive film 23 moving at the same speed as the transfer material P advanced along a conveyance guide 10 and having the unfixed toner image T. The conveyance speed by the pressing roller 22 is preferably substantially the same as the conveyance speed of the sheet during the unfixed toner image formation on the recording sheet. The fixing film 23 speed is determined following this speed.

In this embodiment, the heat generating layer 28 is instantaneously heated upon energization, and therefore, it is not necessary to energize more or less the heat generating layer 28 when the image fixing operation is not performed. For this reason, the temperatures of the pressing roller and the heat resistive sheet are not increased when the image fixing operation is not performed. During the fixing operation, the heat resistive film 23, the toner image T and the transfer material P are interposed between the heat generating layer 28 and the pressing roller 22, and in addition, the heat generating period is short with the result of steep temperature gradient, by which the pressing roller 22 is not easily raised in temperature. The temperature is maintained lower than the fusing point of the toner even when the image forming operation is continuously performed in a practical manner.

In the apparatus of this embodiment, the toner image T made of heat-fusible toner on the transfer material P is first heated and fused by the heat generating member 21 through the heat resistive film functioning as the fixing film, and particularly, the surface portion thereof is heated up to highly above the fusing point, by which the toner is completely softened and fused. At this time, the back-up roller 23 establishes close contact between the heat generating member 21, the fixing film 23, the toner image T and the recording sheet P, so that the heat transfer is efficient.

Thereafter, the heat generation of the heat generating element 21 stops, and the recording sheet P is continued to advance and is separated from the heat generating element 21, by which the heat of the toner image T is radiated so that the toner image T is cooled and solidified. Then, the heat resistive film 23 is separated from the recording sheet P by the separating roller 26 having a large curvature. At this time, in this embodiment, the temperature of the back-up roller 22 is maintained lower than the fusing point of the toner, and therefore, the heat radiation of the toner image T is promoted This reduces the time required for the cooling, so that the size of the apparatus can be reduced.

As described in the foregoing, the toner image T is once completely softened and fused, and then is solidified, and therefore, the coagulation force of the toner is very strong. In addition, since the toner is pressed by the back-up roller 22 when it is softened and fused by heat, at least a part of the toner image T soaks into the surface layer of the transfer material P, and then cooled and solidified. This permits the toner image T to be fixed on the transfer material P without toner off-set to the heat resistive film 23.

Here, the state of the toner referred to in this specification will be described. The toner fusing point used here means the minimum temperature required for fixing the toner and covers the case wherein the viscosity thereof decreases to such an extent as can be said to be fused, at the minimum fixable temperature and the case wherein the viscosity decreases to such an extent as can be said to be softened, at the minimum fixable temperature.

Therefore, even when it is said that the toner is fused for convenience, it actually may mean the viscosity decreases to such an extent that it is actually softened. Similarly, when it is said that the toner is cooled and solidified for convenience, it actually may not be solidified depending on the materials of the toner, but can be said that the viscosity is sufficiently increased.

Figure 3A:
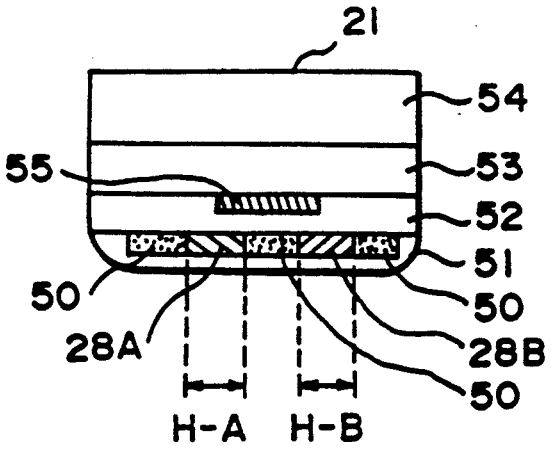
FIG. 3A is an enlarged sectional view of a heat generating element used in the image fixing apparatus according to FIG. 2 embodiment.
Figure 3B:
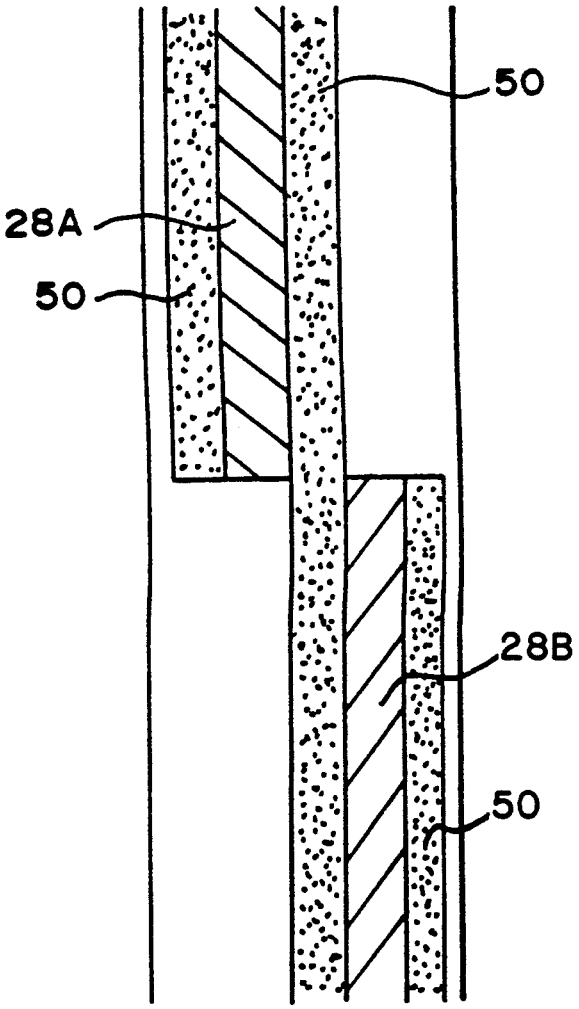
FIG. 3B is an enlarged front view of a heat generating element used in the image fixing apparatus according to the embodiment of FIG. 2.

FIGS. 3A and 3B show in an enlarged scale the structure of the heat generating element 21, wherein FIG. 3A is a sectional view, and FIG. 3B is a front view. As shown in FIGS. 3A and 3B, the heat generating element 21 comprises an electrode 50, a surface protection layer 51, an insulating member 52, a heat insulating layer 53 and a base plate 54. The heat insulating layer 53 is made of a material having a low thermal conductivity and a heat resistivity such as Bakelite. It prevents heat radiation from the heat generating layer 28A and the heat generating layer 29B. A temperature detecting element 55 is a thermister having a low thermal capacity and is disposed close to the heat generating layer 28A (28B) through the thin insulating member 52. The heat generating element 21 heats the toner through the heat resistive sheet 23 in the heating portions H-A (H-B). As shown in FIG. 3B, the heat generating layers 28A and 28B are disposed at opposite lateral sides of an electrode 50, and are alternately energized.

Figure 4:
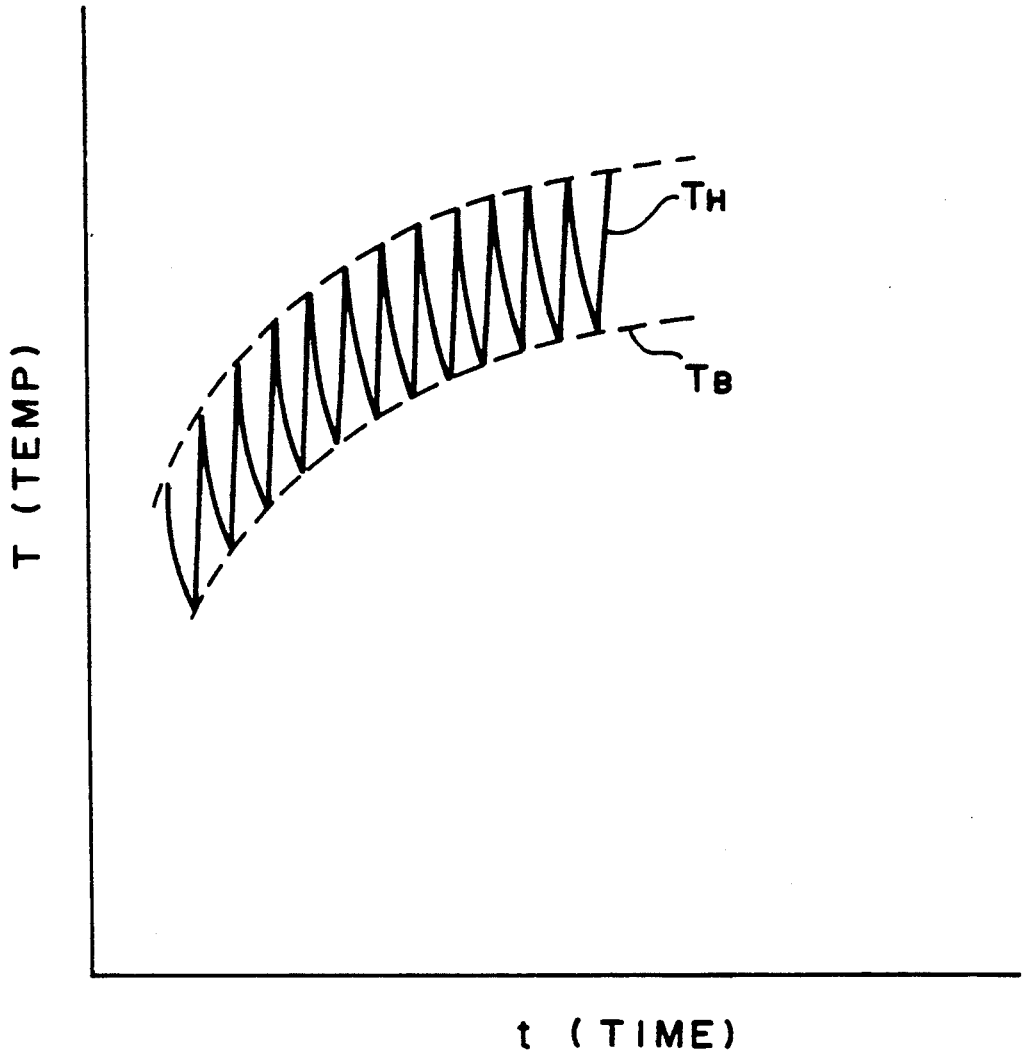
FIG. 4 illustrates heating steps of the image fixing device of FIG. 2.

FIG. 4 is a graph of the temperatures of the heating portions H-A and H-B and the temperature detected by the temperature detecting element 55 when the heat generating layers are pulsewisely energized in the image fixing apparatus 20 of FIG. 2. The former temperatures were obtained by non-contact measurement using an infrared radiation thermometer, and the latter was obtained by converting the output power of the temperature detecting element 55. The period of the pulse was approximately 10 msec, and the energization period was approximately 2 msec when the graph was obtained. The temperature of the heating portion H-A (H-B) steeply increases upon the energization, and then, it steeply decreases upon deenergization. In this embodiment, the deenergization period is sufficiently longer than the energization period, and the heat insulating layer 53 is provided. For those reasons, the temperatures of the back heat generating layers 28 (28A, 28B), the insulating member 52 and the temperature detecting element 55 become substantially equivalent when the minimum level of the pulsewise waveform is taken. The temperature detecting element 55 used in this embodiment can not respond to the pulsewise temperature change with the period as short as 10 msec, so that it indicates substantially the minimum level of the pulse waveform. Therefore, the envelope line for the minimum levels of the surface temperatures of the heating portion H-A (H-B) is substantially the same as the detected temperature by the temperature detecting element 55.

Figure 5:
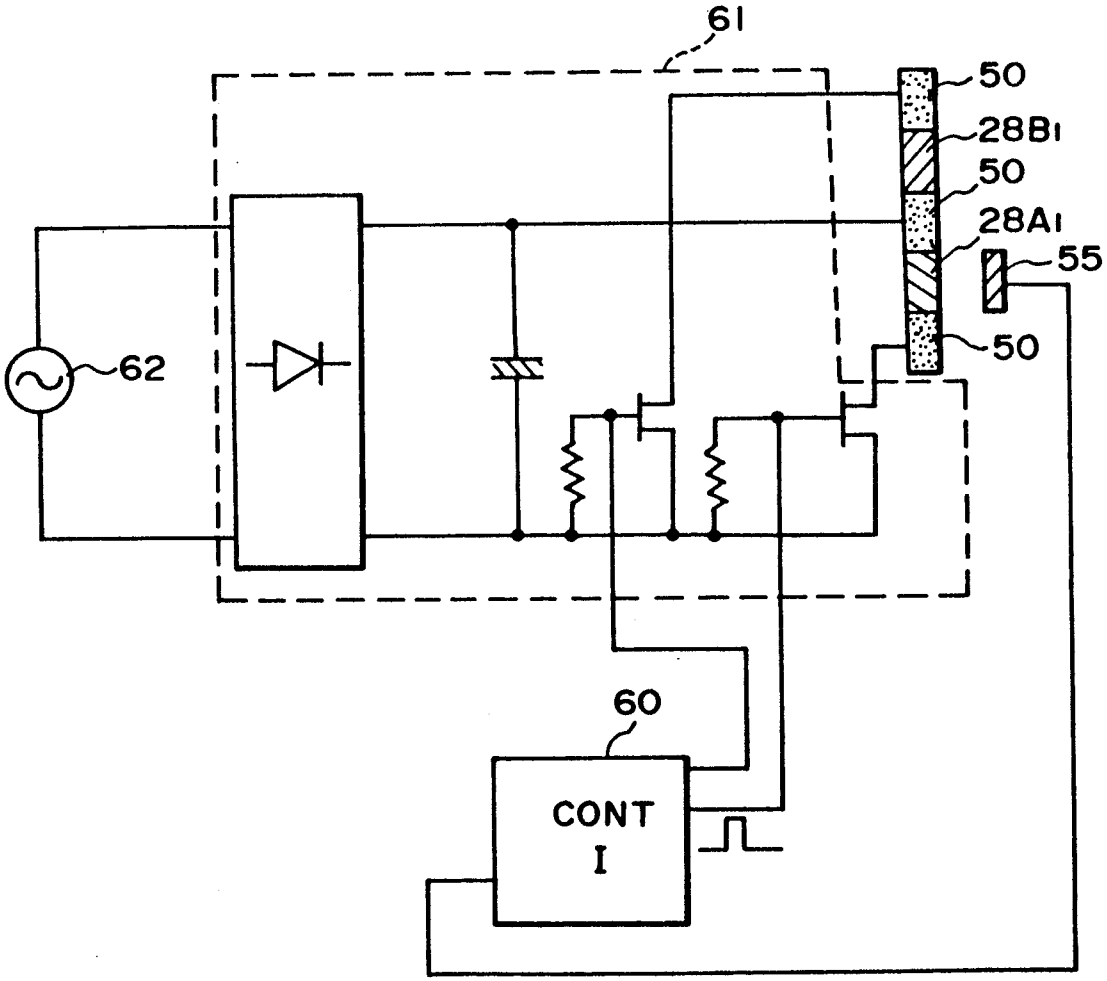
FIG. 5 shows the structure for supplying electric power to the heat generating layer of FIG. 3A.

FIG. 5 illustrates the structure for the power supply to the heat generating layers 28A and 28B of FIG. 3. In this structure, a control circuit (I) 60 includes a microcomputer and controls a power source 61 in accordance with the temperature detected by the temperature detecting element 55, and controls the power supply to the heat generating layer 28A (28B) by changing the pulse width of the power supply to the heat generating layer 28A (28B). Designated by a reference 62 is utility AC source.

The reasons for effecting such power control in this embodiment will be explained. In this embodiment, the heat insulating layer 53 is provided in order to prevent the heat radiation from the heat generating layer 28A (28B) to the base plate 54. This is done for the purpose of reducing the wasteful heat radiation to increase the energy consumption efficiency, by which the energy consumption can be saved, and simultaneously, the temperature rise within the apparatus due to the heat radiation from the base plate 54 is reduced. By mere heat insulation without controlling the power supply to the heat generating layer 28A (28B), the amount of heat generation is significantly larger than the heat radiation with the result that the heat generating layer 28A (28B) and the heating portion H-A (H-B) are overheated. If this occurs, there is a liability that the heat generating layer 28A (28B) and the heat resistive sheet 23 are broken.

As will be understood, the control of the power supply to the heat generating layer 28A (28B) is effective to prevent the overheating of the heating portion H-A (H-B) when the insulating layer 53 is employed.

The method of power control in this embodiment will be explained. In the fixing system using pulse heating in this embodiment, the toner is heated for only a short period in the order of msec, as described hereinbefore, and therefore, the temperature of the heating portion H-A (H-B), rather than the toner heating period, is determinative in terms of the fixing property. In response to the maximum temperature reached by the heating portion H-A (H-B), the temperature of the toner layer is increased. Therefore, the sufficient image fixing property can be provided without wasting the electric power, by controlling the power supply to the heat generating layer 28A (28B) so that the maximum temperature of the heating portion H-A (H-B) is maintained during the fixing operation substantially at a temperature $T_{HO}$ which is a temperature of the heating portion H-A (H-B) when the toner is sufficiently softened for the fixing.

Figure 6:
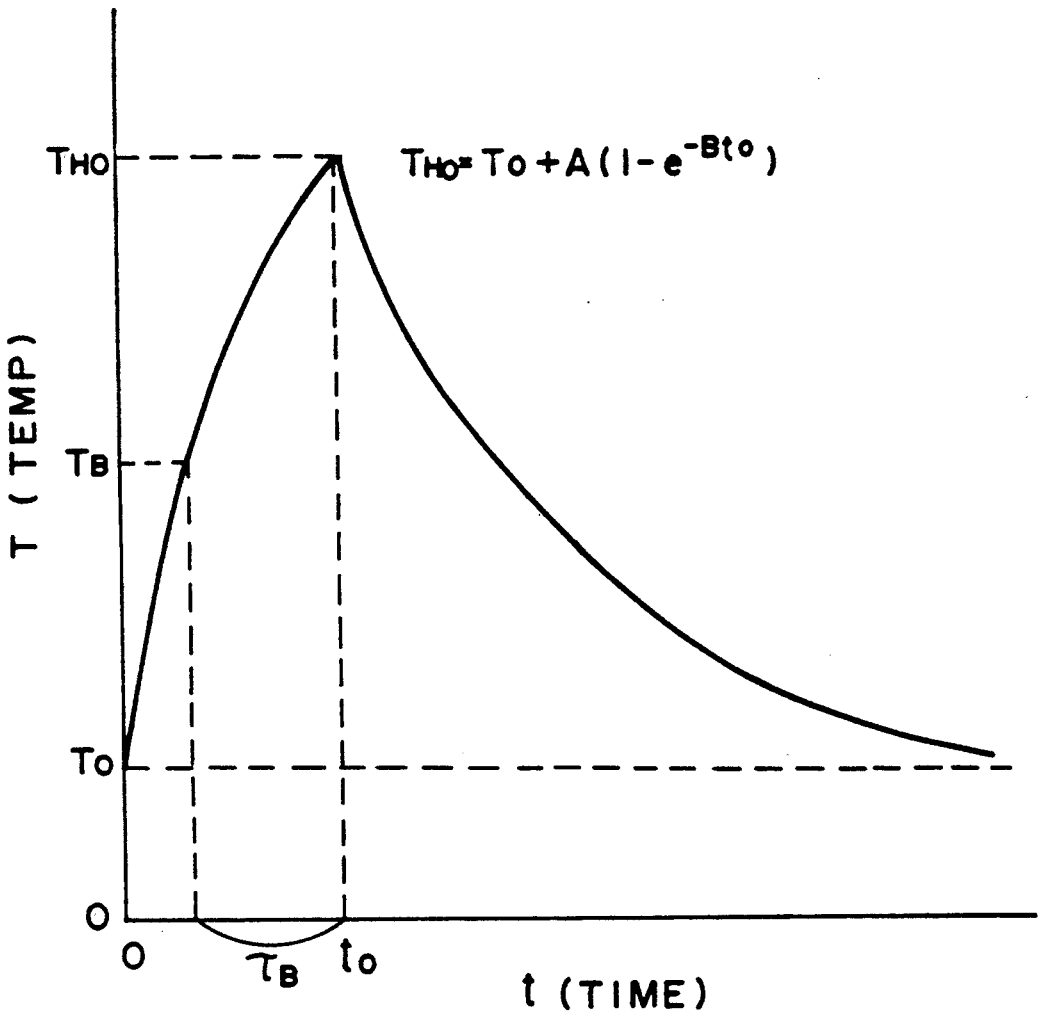
FIGS. 6 and 7 illustrate the relations between the temperature of the heating portion of FIG. 3A and time.

Referring to FIG. 6, when the heating portion H-A (H-B) having a reference temperature T0 is heated for a period of time $t_0$ by energizing the heat generating layer 28A (28B) with a constant voltage V, the temperature of the heating portion H-A (H-B) reaches the fixing temperature $T_{HO}$. It is known that the temperature $T_{HO}$, the temperature T0, the time $t_0$ satisfy the following:

$$T_{HO}=T0+A(1-e^{-Bt_0}) \quad (1)$$

where A and B are constant determined by the power supply conditions to the heating layers 28A (28B) and the heat transfer passages from the heating portion H-A (H-B). From the equation (1), $$t_0 = -(1/B)ln[1+(T0-T_{HO}/A)] \quad (2)$$

Therefore, $t_0$ is determined if $T_{HO}$ A and B are empirically determined beforehand, and if T0 is measured.

In this embodiment, where the heat generating layer 28A (28B) is energized pulsewisely with sufficiently small duty ratio, the temperature of the heating portion H-A (H-B) is substantially equal to the temperature detected by the temperature detecting element 55, when the temperature of the heating portion H-A (H-B) pulsewisely changing shows the minimum temperature, that is, immediately before the pulse energization start. Therefore, using the temperature detected by the temperature detecting element 55, the control circuit (I) 60 in FIG. 5 calculates the next energization period in accordance with the above equation (2), and the heat generating layer 28A (28B) is energized by the power source 61 for the period thus calculated.

Figure 7:
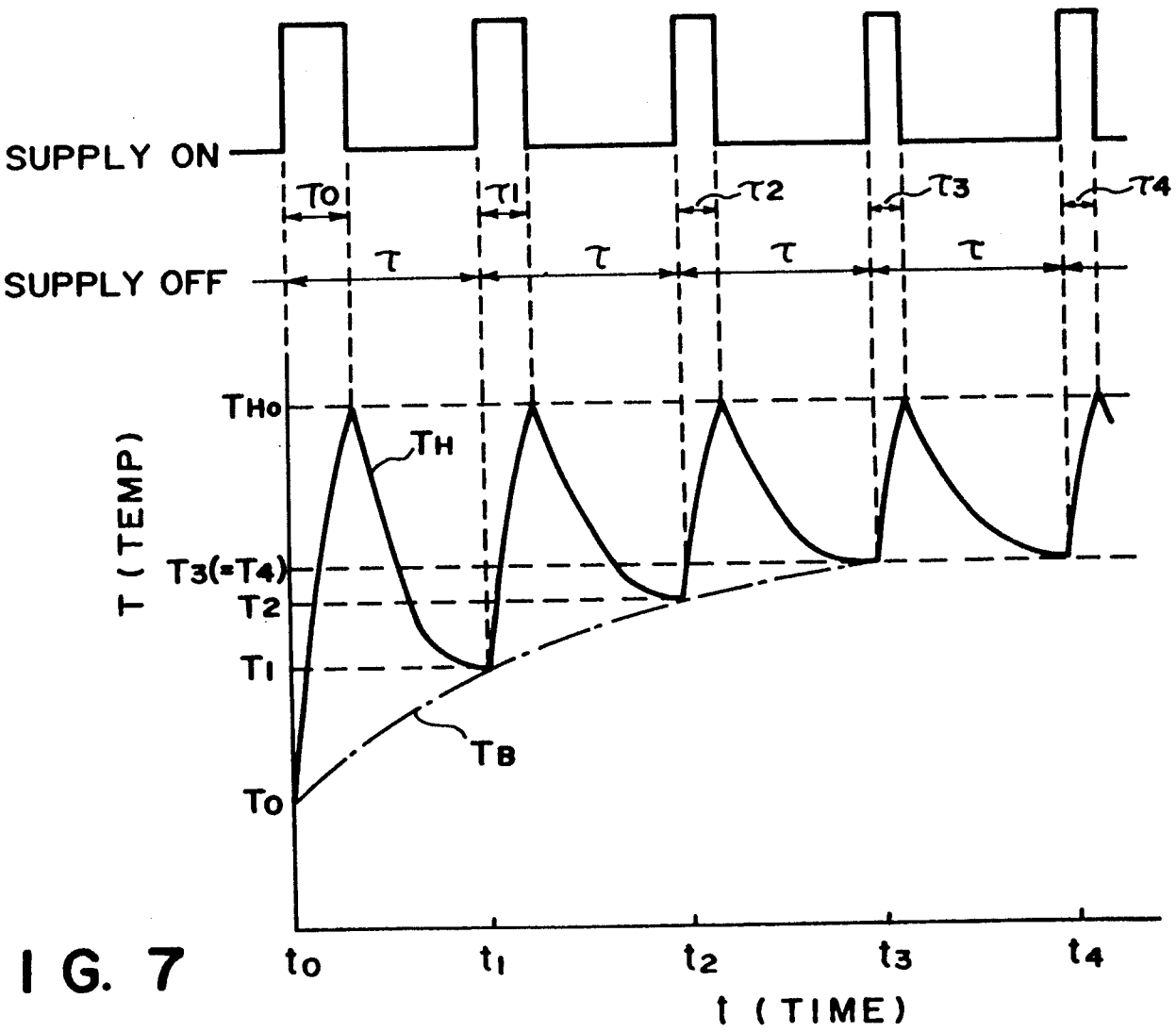

FIG. 7 shows a graph indicating the temperature change of the heating portion H-A (H-B) during the fixing operation with time, together with the timing of the energization of the heat generating layer 28A (28B), in this embodiment.

As described in the foregoing, in this embodiment, the power supply voltage V supplied to the heat generating layer 28A (28B) is constant, and the period $\tau$ of the energization pulses is constant. Assuming that the fixing operation is started at the time $t_0$ when the temperature of the heating portion H-A (H-B) is T0, the temperature of the heating portion H-A (H-B) reaches the fixing temperature $T_{HO}$ by the energization for the pulse width $\tau_0$ determined from the temperature T0, and thereafter, decreases down to a temperature T1 in the period of no power supply $(\tau-\tau_0)$ which is sufficiently longer than the period $\tau_0$. Next, at time $t_1$ which is pulse period $(\tau)$ later than the time $t_0$, the second energization is effected to the heat generating layer 28A (28B) for a pulse width $\tau_1$ determined from the temperature T1, by which the temperature of the heating portion H-A (H-B) increases again to the fixing temperature $T_{HO}$, and thereafter, it decreases upon the stoppage of the energization.

In a similar manner, the temperature is detected by the temperature detecting element 55 for each pulse period $\tau$ upon the start of the energization, the heat generating layer 28A (28B) is energized for the pulse width period determined by the equation (2) in accordance with the detected temperature, by which the maximum temperatures of the heating portion H-A (H-B) can be maintained at the fixing temperature.

Figure 8:
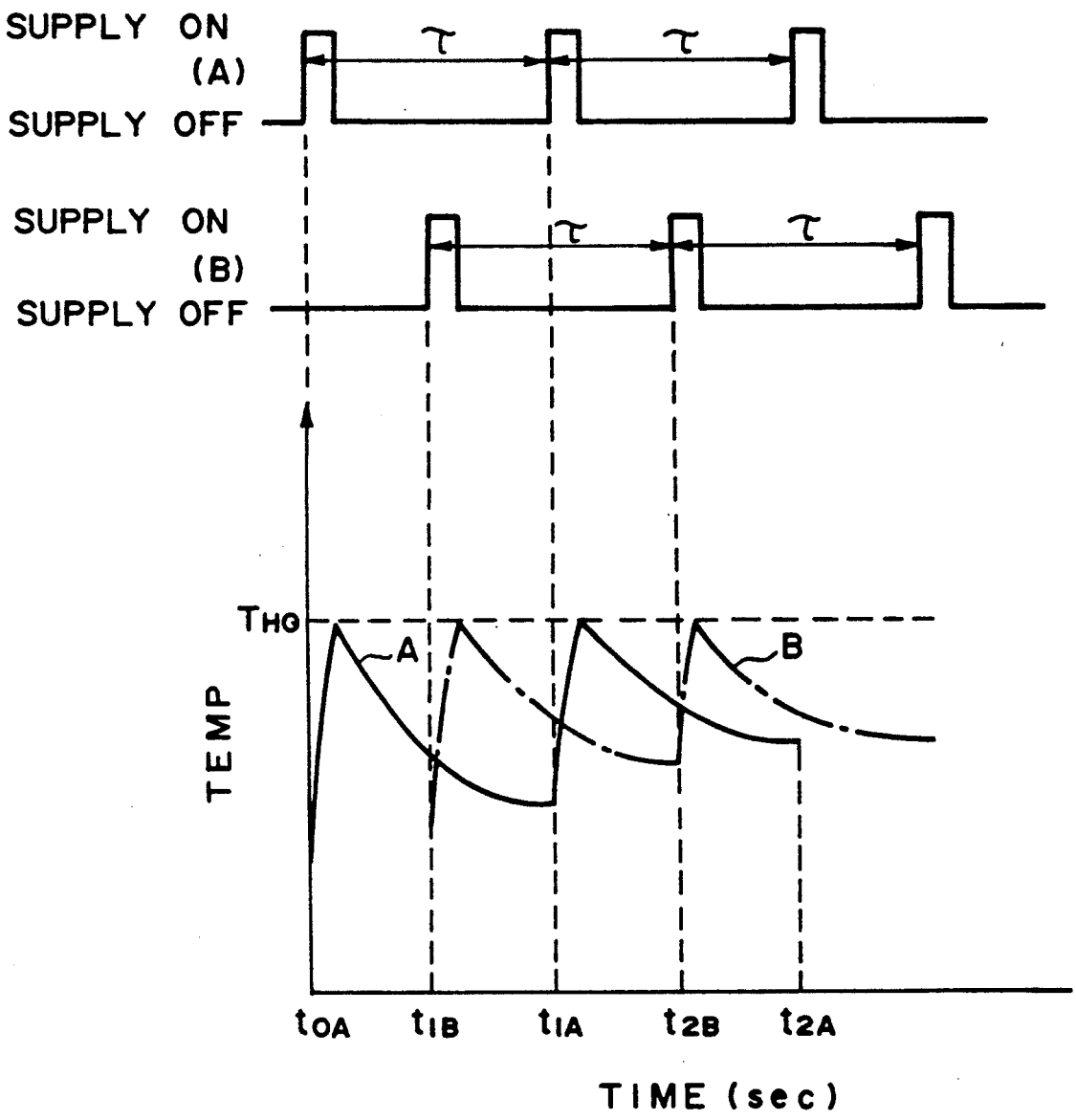
FIG. 8 illustrates the energization timing of the heat generating layer of FIG. 3A.

Referring to FIG. 3, the heat generating layer of the heat generating element 21 is divided into the heat generating layer 28A and the heat generating layer 28B, and the divided heat generating layers 28A and 28B are energized as shown in FIG. 8.

Among the period $\tau$ of the energization of the heat generating layer 28A (28B), the conveyance speed Vp of the transfer material P and the heating width L, there are the following relationships:

$$(Vp/L) \leqq (1/\tau) < (2Vp/L)$$

The energizations of the heat generating layers 28A and 28B are carried out alternately, and the time relations are:

$$t_{0A} < t_{1B} < t_{1A} < t_{2B} < t_{2A} < \cdots$$

It is possible that the control profiles are made different for the heat generating layer 28A and for the heat generating layer 28B.

The control of the energization for the heat generating layers 28A and 28B in accordance with the size of the recording material will be described.

Figure 9:
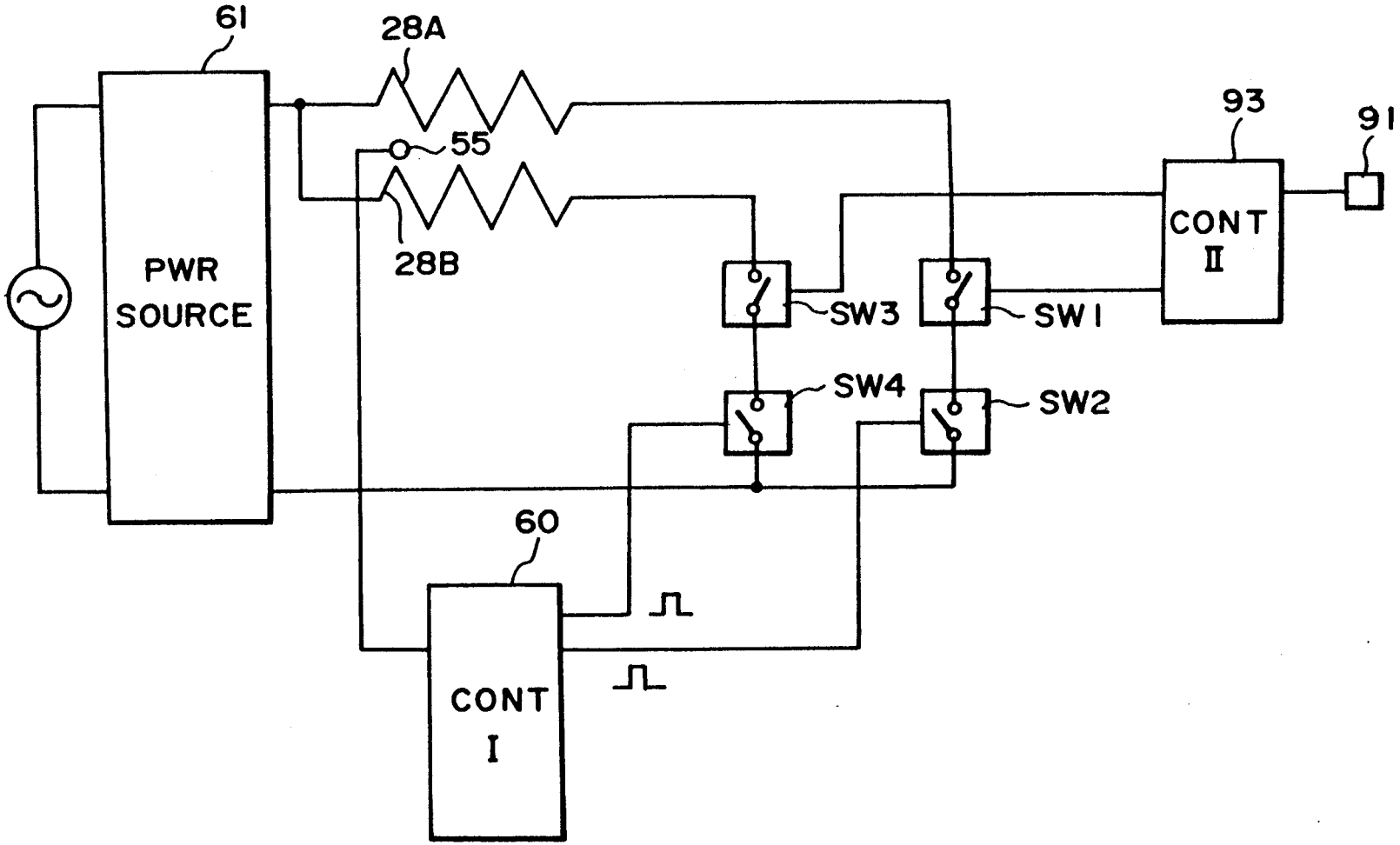
FIG. 9 illustrates the control for the energization.

Referring to FIG. 9, there is shown a block diagram for the control of the power supply in accordance with the size of the transfer material. The power supply control to the heat generating layers 28A and 28B using the control circuit (I) is the same as described above. Switches SW1 and SW3 are operated by a control circuit (II) 93 in accordance with the size of the transfer material. The control circuit (II) 93 controls the switches SW1 and SW3 in accordance with the signal produced by a transfer material width sensor 91. The control method is such that when the transfer material is present at the position of the heat generating layer 28A, the switch SW1 is rendered on, whereas when the transfer material is present at the position of the heat generating layer 28B, the switch SW3 is rendered on. Switches SW2 and SW4 are operated by the control circuit (I) 60. In this manner, the heating of the portion beyond necessity is prevented, whereby the power consumption is reduced, and simultaneously, the pressing roller is prevented from overheating.

Figure 10:
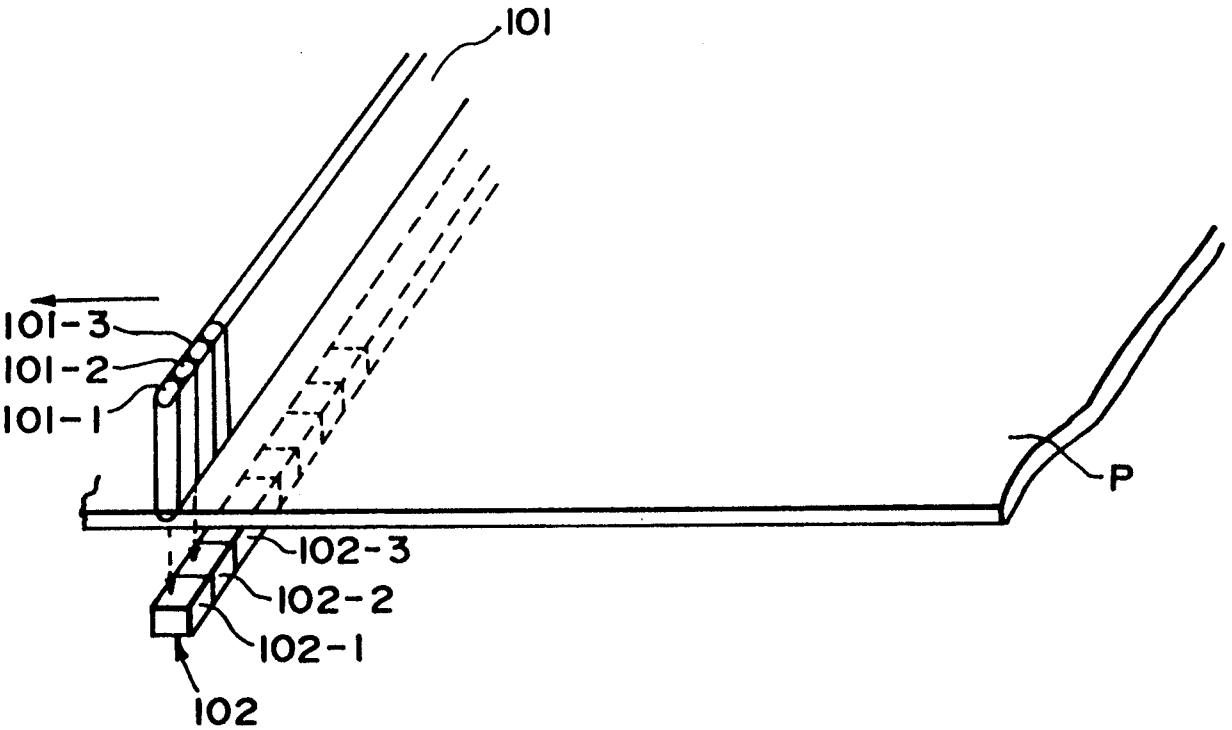
FIG. 10 is an enlarged perspective view of a transfer material width sensor used in FIG. 9.

Referring to FIG. 10, the transfer material width sensor 91 used in FIG. 9 structure is shown in detail. As shown in FIG. 10, LED array 101 (101-1, 101-2, 101-3, . . . ) and a corresponding photoreceptor array 102 (102-1, 102-2, 102-3, . . . ) are disposed for interposing the transfer material P. They are opposed in the detection perpendicular to the conveyance direction of the transfer material. More particularly, the LED elements 101-1, 101-2, 101-3, . . . , 101-m and the photoreceptor elements 102-1, 102-2, 102-3, . . . , 102-m are disposed opposed to each other, respectively. The number of the LED elements and the number of the photoreceptor elements are equal. By checking the photoreceptor elements receiving the light, and the photoreceptor elements not receiving the light, the width position of the transfer material P can be detected.

Figure 11A:
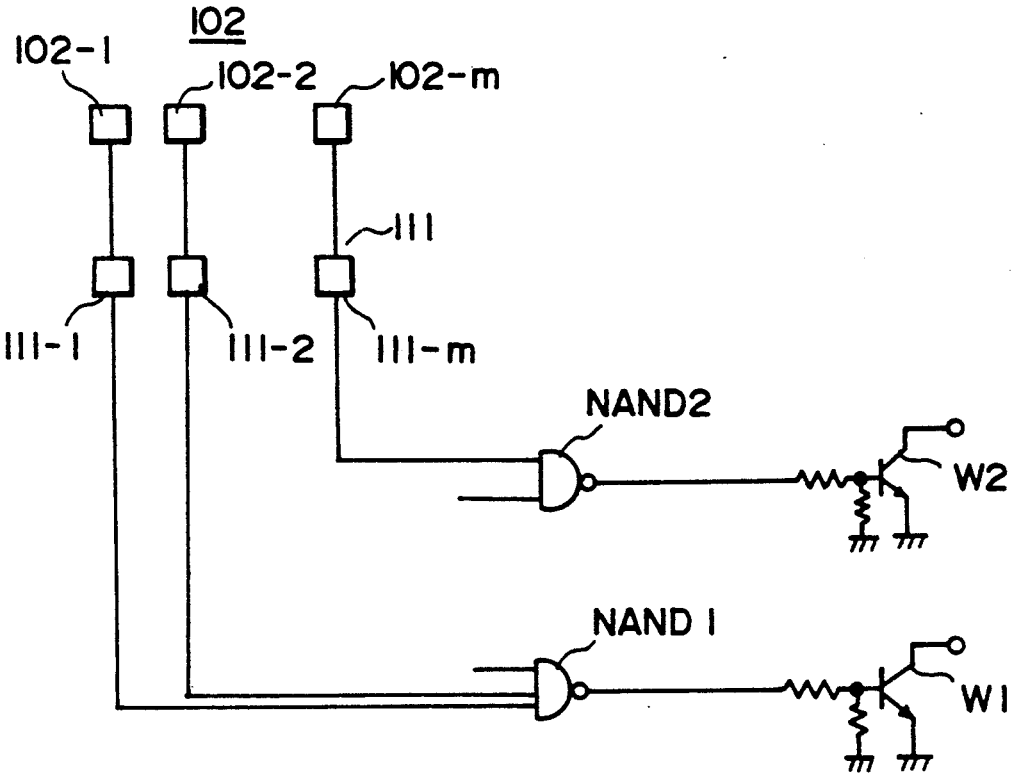
FIGS. 11A and 11B are circuits for the control circuit (II) of FIG. 9.
Figure 11B:
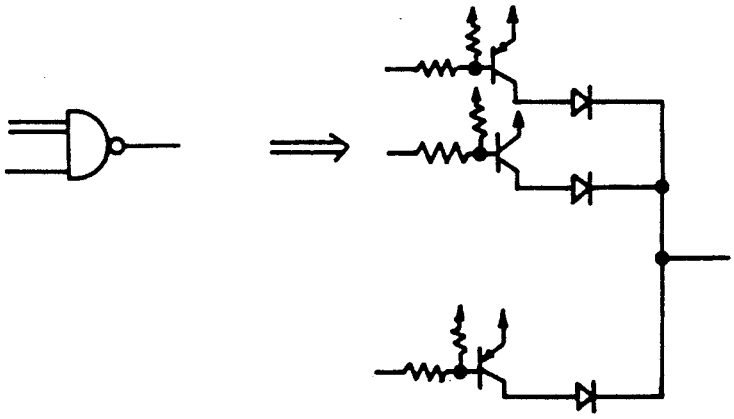

FIG. 11 shows the detail of the control circuit (II) 93 of FIG. 9. The signals from the photoreceptor array 102 (102-1, 102-2, . . . , 102-m) are supplied to electric signal converter elements 111 (111-1, 111-2, . . . , 111-m) via signal line such as optical fibers. Each of the electric signal converter elements 111 produces "H" signal when the photoreceptor element 102 receives light, and produces "L" signal when it does not receive the light. The output line of the electric signal converter elements 111 are grouped correspondingly to the dividing positions of the divided heat generating layers, and they are connected to respective NAND gates. In this embodiment, the heat generating layer 28 is divided into the two layers 28A and 28B (FIGS. 3, 5 and 9), and therefore, the output line of the electric signal converter elements 111 are unified into two groups. It is assumed that the first group includes the electric signal converter elements 111-1, . . . , 111-k, and the elements 111-k+1, . . . 111-m. In place of a multi-input NAND gate, the circuit shown in FIG. 11B may be used. If at least one of the electric signal converter elements 111-1, . . . 111-k produces an output signal "L", that is, if the transfer material P exists at a portion covered by those elements, the output of the NAND 1 gate is "H", by which a driving transistor Tr1 of the switch SW1 is actuated, to actuate the switch SW1. Similarly, when the transfer material P exists in the region covered by the electric signal converter elements 111-k+1, . . . 111-m, the transistor Tr2 is actuated, by which the switch SW3 is rendered on. Where the heat generating layer is divided into n groups, the outputs of the electric signal converter elements 111 are unified into n groups corresponding to the positions where the heat generating layers are divided, and the outputs are supplied to n NAND gates.

By controlling the heat generating regions in accordance with the size of the recording material, more particularly, by not generating the heat at a portion where the recording material does not pass, the local overheating is prevented, when the image fixing operation is continuously performed.

Therefore, the deformation of the film or the fusing of the heat generating layer can be prevented, thus permitting to reduce the thermal capacity of the heating element. In addition, the energy can be saved, and the temperature rise of the pressing roller can be prevented.

Figure 12:
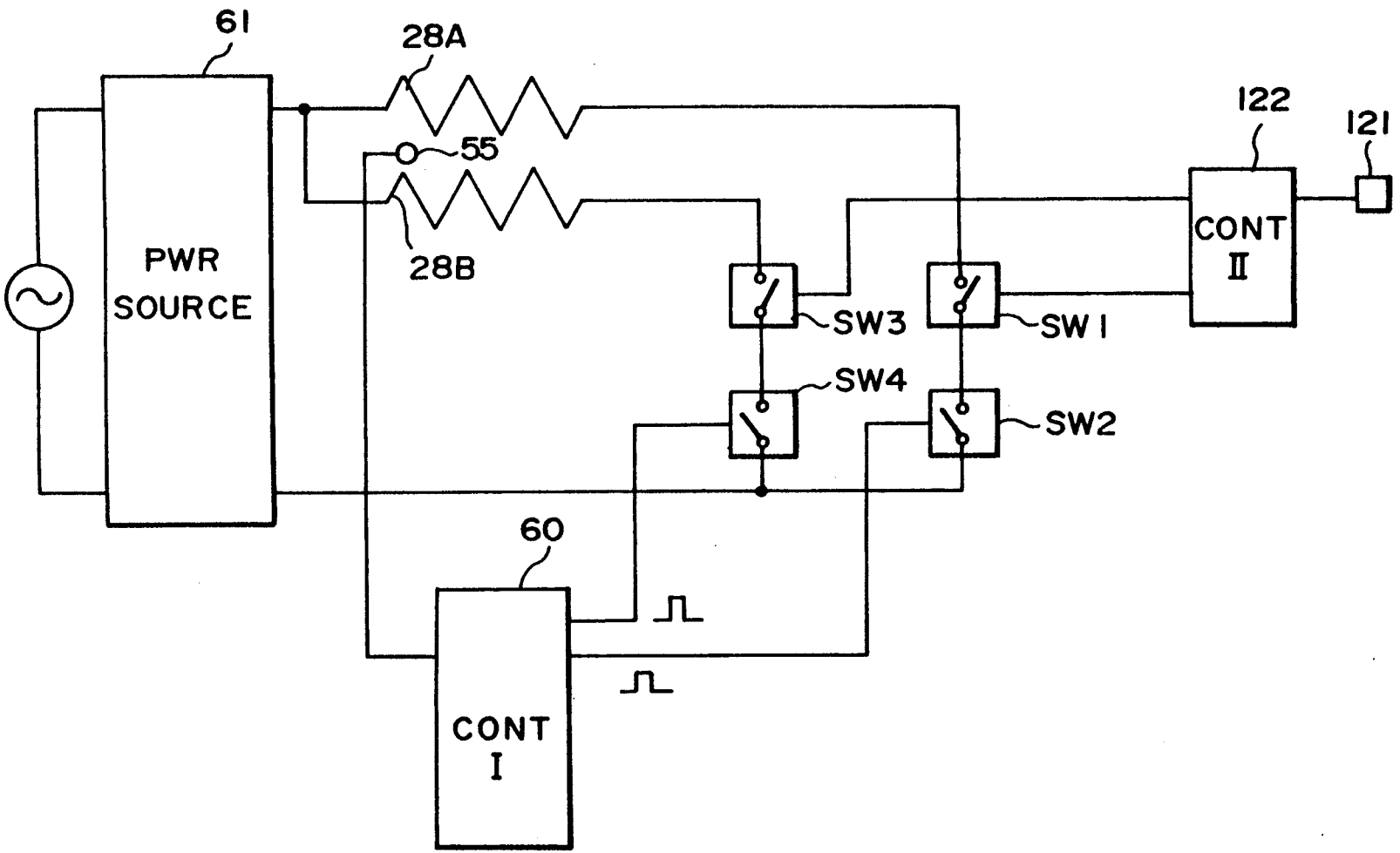
FIG. 12 is a circuit for power supply control in accordance with a size of an original image in this embodiment.

Referring to FIG. 12, another embodiment will be described. The apparatus of this embodiment will be used with the copying apparatus shown in FIG. 1. In the foregoing embodiment, the heat generating region of the heating member is controlled in accordance with the size of the recording material, but in this embodiment, the heat generating region is controlled in accordance with the size of the original. The control circuit (I) 60 of FIG. 12 is the same as the control circuit (I) of FIG. 9. Switches SW1 and SW3 are operated by the control circuit (III) 122 in accordance with the size of the original. The control circuit (III) 122 operates the switches SW1 and SW3 in accordance with an output of an original width sensor 121. The control method for the switches SW1 and SW3 is similar to the control method in the foregoing embodiment.

Figure 13A:
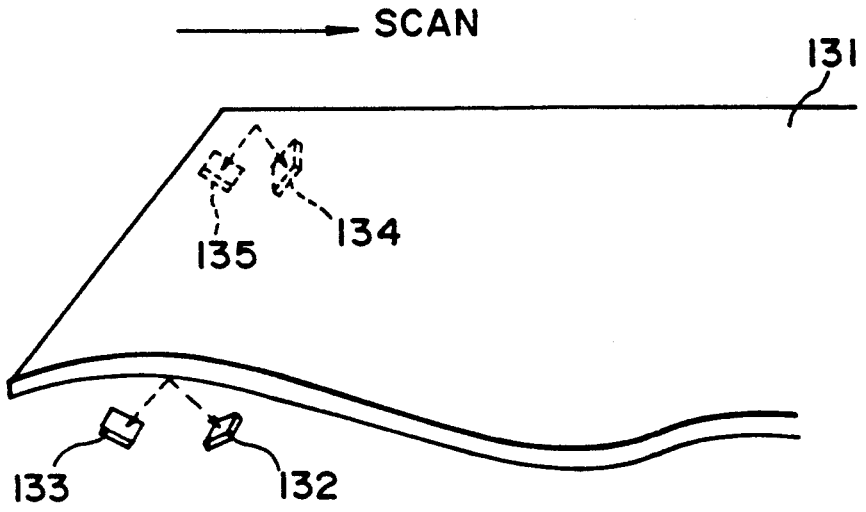
FIGS. 13A and 13B illustrate the original width sensor of FIG. 12.

FIG. 13A shows the original width sensor 121 used in FIG. 12, in more detail. The original 131 is placed on the original supporting platen such that a corner of the original 131 is in alignment with an original reference position. There are provided light emitting elements 132 and 134 and light receiving elements 133 and 135. The light emitted from the light emitting elements 132 and 134 and reflected by the original 131 is received by the photoreceptor elements 133 and 135. The light emitting elements 132 and 134 are placed at the positions corresponding to the dividing positions of the heat generating layer, in the direction perpendicular to the original scanning direction.

Figure 13B:
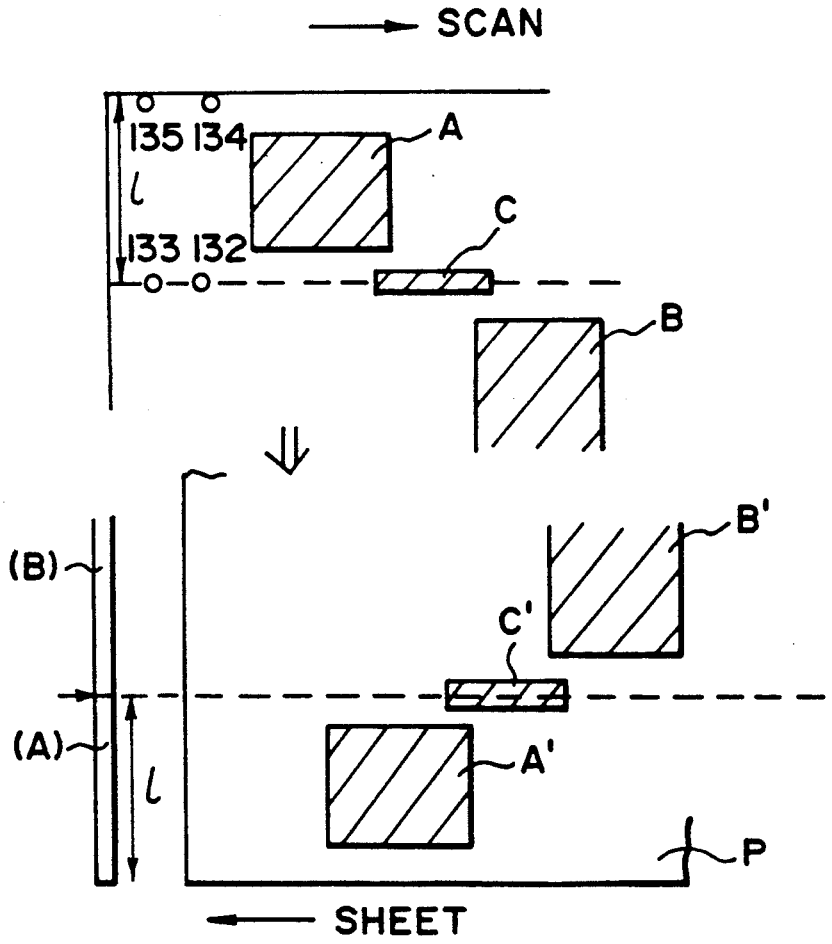

The corresponding positions will be described. As shown in FIG. 13B, the images of the hatched portions A, B and C on the original supporting platen are formed at the positions A', B' and C', respectively, on the transfer material P as the unfixed toner images. At this time, a distance 1 from the dividing position to the end of the heat generating layer corresponds to a distance between the light emitting elements 132 and 134, and the distance between the light receiving elements 133 and 135.

Figure 14:
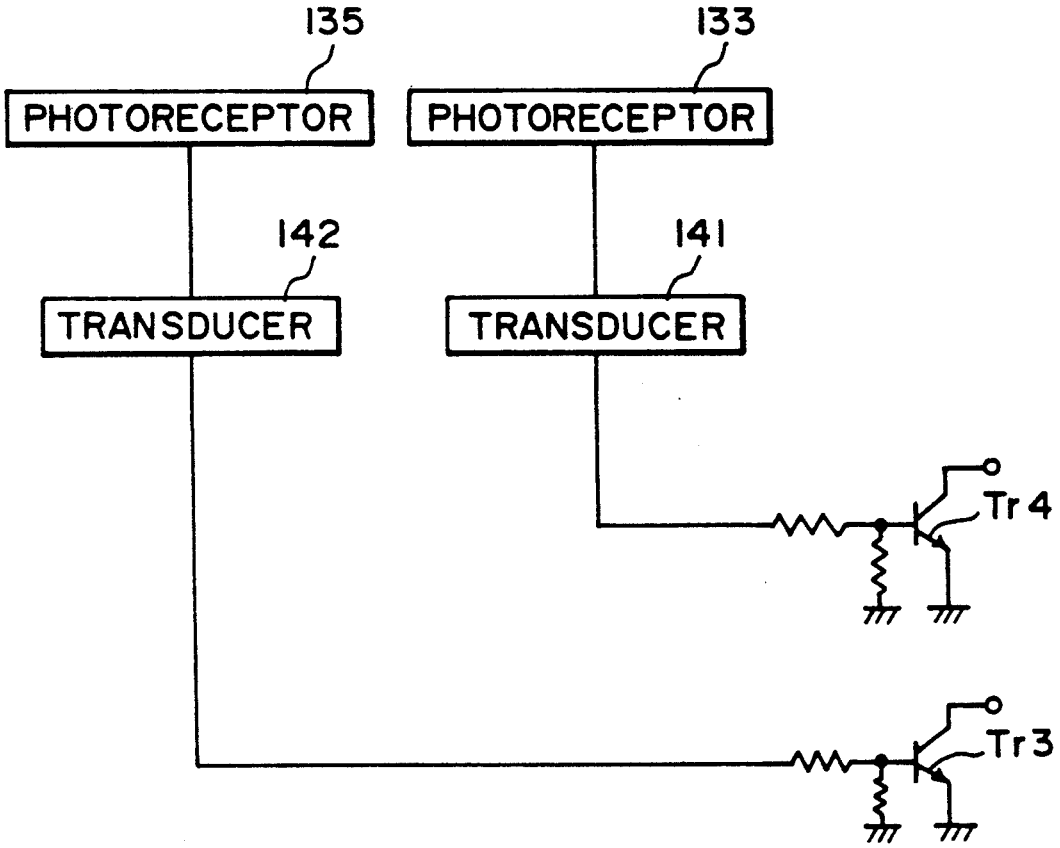
FIG. 14 is a circuit diagram of a control circuit (III) of FIG. 12.

FIG. 14 shows the detailed structure of the control circuit (III) 122 of FIG. 12. A transistor Tr3 actuates the switch SW1, and a transistor Tr4 actuates the switch SW3. The signal from the photoreceptor element 133 is supplied to an electric signal converter circuit 141. When the light receiving element 133 receives light, that is, when the original is larger than the dividing position, the electric signal converter circuit 141 produces "H" signal. The driving transistor Tr4 actuates the switch SW3 when the electric signal converter circuit 141 produces "H" signal. Similarly, when the photoreceptor element 135 receives light, the electric signal converter circuit 142 produces "H" signal, and the transistor Tr3 actuates the switch SW1. When the switch SW1 is actuated, the heat generating layer 28A is energized, and the heat generating layer 28B is energized when the switch SW3 is actuated. Since the light emitting element 134 and the photoreceptor element 135 are located at the original reference position, and therefore, they can be used for detecting presence and absence of the original. By controlling the energization of the heat generating layer in accordance with the size of the original, the power consumption can be saved, and the overheating of the pressing roller can be prevented.

When the heat generating layer is divided into n groups, (n-1) sets of the light emitting elements and the photoreceptor elements are disposed at positions corresponding to the dividing positions, and the similar control is possible. In consideration of the fact that the light emitting elements 134 and the photoreceptor elements 135 are disposed at the original reference position, the switch SW1 and the transistor Tr3 may be omitted, and the heat generating layer 28A is energized irrespective of the size of the transfer material.

Figure 15:
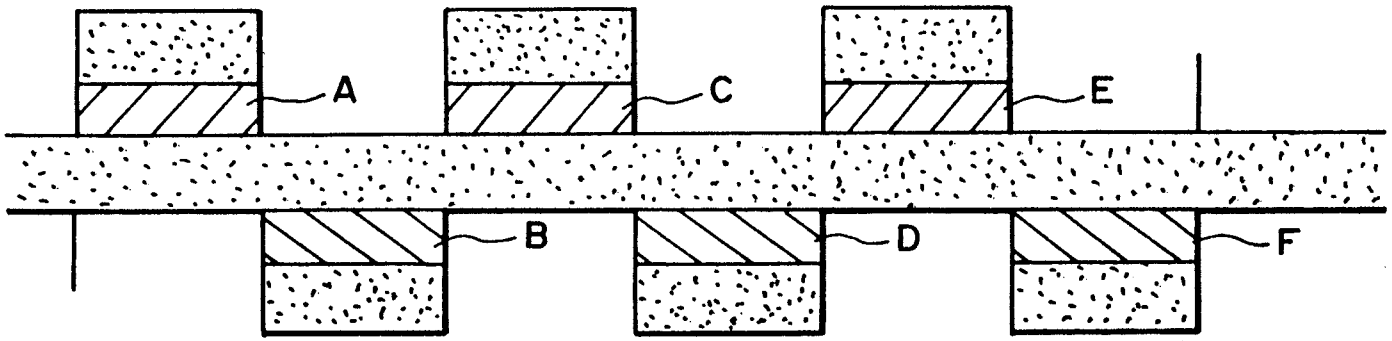
FIG. 15 is an enlarged front view of a heat generating layer divided into a number of sections.

FIG. 15 shows an embodiment wherein the h[at generating layer is divided into numerous groups (A), (B), (C), (D), (E), (F), . . . The dividing of the heat generating layer is not necessarily the dividing into equal dimensions. For example, it may be divided in consideration of the sizes of the transfer materials to be used, for example, A4, B5, post card and business card.

In the first embodiment described hereinbefore, numerous light emitting elements and photoreceptor elements are used to detect the size of the recording material, but they may be disposed correspondingly to the divided heat generating regions. The control circuit may be the same as shown in FIG. 12, although the signals of the electric signal converter circuit are reversed. By doing so, the number of the light emitting elements and the number of photoreceptor elements may be equal to the number of divisions.

Although the size of the recording material is directly detected by the recording material size sensor, but it is also preferable that the sheet feeding cassettes accommodating the recording materials are provided with size indicating members, respectively, and the size of the recording materials is detected on the basis of which cassette is used. In this case, the control circuit and the sensor structures are simplified because the heat generating layers to be energized can be determined beforehand, in response to the mounting of the feeding cassette.

In the second embodiment described hereinbefore, the image region is discriminated on the basis of the original size detection. Where the image forming apparatus is provided with region designating means for designating the region to be subjected to the image formation, such as a digitizer, the energization region may be controlled in response to the region designating signal from the designating means. By doing so, the energization region can be further limited.

It is a possible alternative of the first embodiment that the output signal of the transfer material width sensor or the output signal of the control circuit (II) is supplied to the control circuit (I) to stop the temperature control signal of the control circuit (I) to stop the energization of the heat generating layer. By doing so, the necessity for the independent power supply means is eliminated. In addition, the output of the original width sensor is transmitted to the control circuit (I), and the output signal of the control circuit (I) is changed, by which the similar control is possible.

In the second embodiment, the original width sensor may comprises an LED array and photoreceptor array. The control circuit or the like is the same as the transfer material width detecting means of the first embodiment. However, the output signals from the electric signal converter circuits have to be reversed. By doing so, the control is possible when the original is placed at any position on the original supporting platen.

Figure 16:
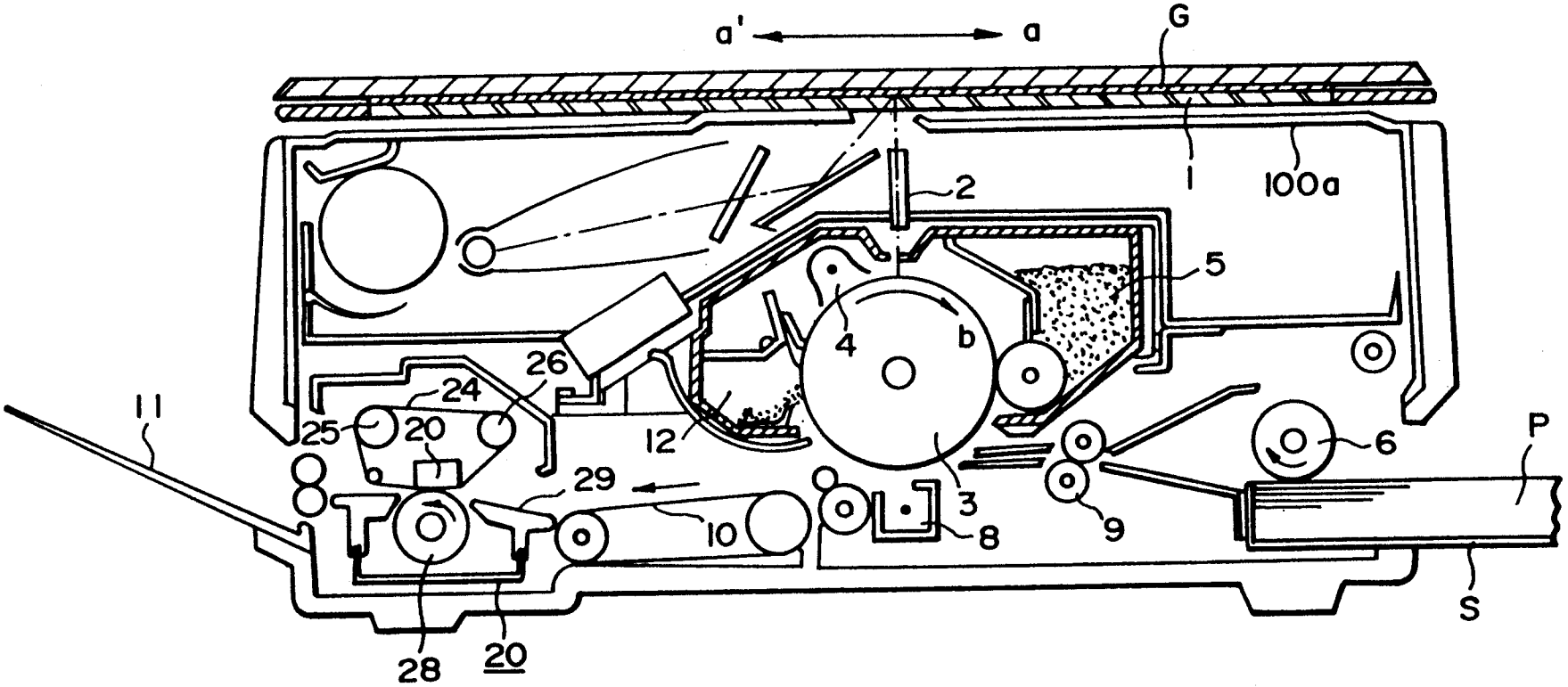
FIG. 16 is a longitudinal sectional view of an image forming apparatus using an image fixing device according to a further embodiment of the present invention.

Referring to FIG. 16, a further embodiment will be described. FIG. 16 is a sectional view of an image forming apparatus using the fixing apparatus of this embodiment. Generally, it is similar to the apparatus of FIG. 1, and therefore, the detailed description is omitted, except for the fixing apparatus.

Figure 17:
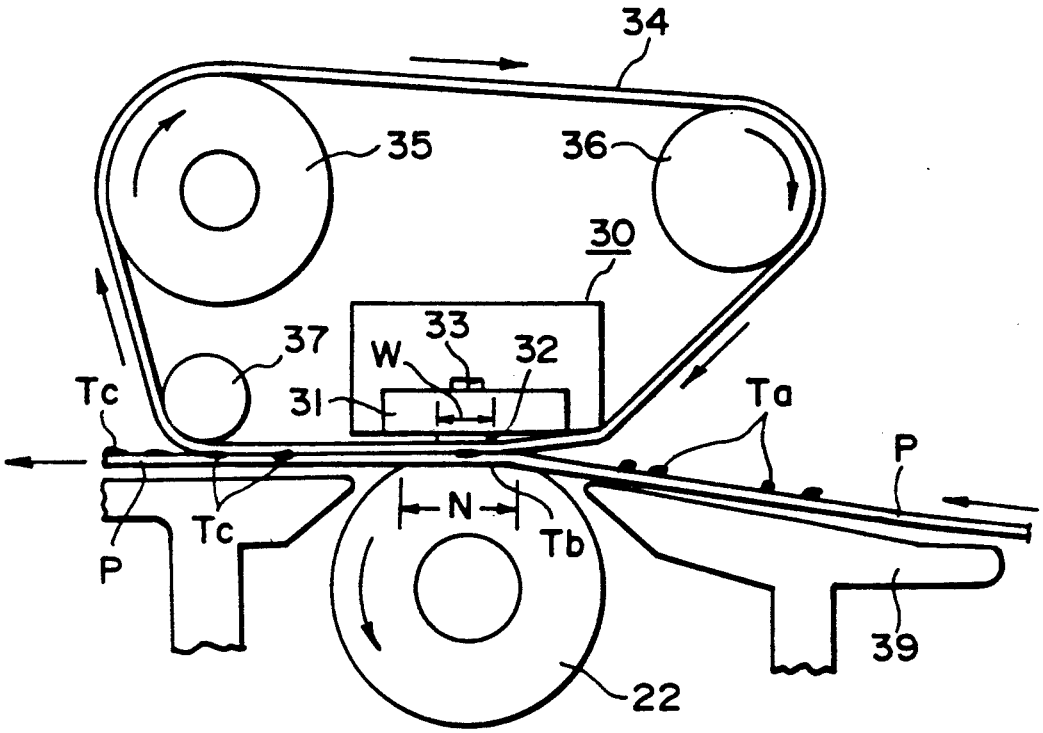
FIG. 17 is an enlarged view of the image fixing apparatus according to this embodiment.

FIG. 17 is a sectional view of the fixing apparatus according to this embodiment.

The fixing apparatus includes a fixing film 34 in the form of an endless belt, which is stretched around a left side driving roller 35, a light side follower roller 36, a separation roller 37 disposed below the driving roller 35, and a low thermal capacity linear heater 30 disposed below the driving roller 35 and the follower roller 36. Those four elements 35, 36, 37 and 30 are extended parallel to each other.

The follower roller 36 functions also as a tension roller for the fixing film 34 in the form of the endless belt, and the fixing film 34 is rotated by the clockwise driving rotation of the driving roller 35, in the clockwise direction at a predetermined speed, that is, the same speed as the transfer material P having the unfixed toner image Ia thereon, without crease, snaking movement or delay.

A pressing member 22 is in the form of a pressing roller having a rubber elastic layer having a good releasing property, such as silicone rubber. It is urged by an unshown urging means to the bottom surface of the heater 30 with the bottom travel of the endless fixing film 24 interposed therebetween, under the total pressure of 4–7 kg, for example. It is rotatable codirectionally with the transfer material sheet P conveyance, that is, the counterclockwise direction.

The fixing film 34 in the form of an endless belt is rotated and is repeatedly used for heat-fixing the toner images, and therefore, the material thereof has good heat resistivity, releasing property and durability, and has a small thickness generally not more than 100 microns, preferably not more than 50 microns. For example, it is a single layer film of heat resistive resin material such as polyimide, polyetherimide or PEA, copolymer resin of tetrafluoroethylene and perfluoroalkyl vinyl ether, or a compound film including, for example, a film having a thickness of 20 microns and a releasing layer of 10 micron thickness of PTFE (tetrafluoroethylene resin) added with conductive material at least at a side contactable to the image.

The low thermal capacity linear heater 30 functioning as the heating member, which will be described in detail hereinafter, includes, in this embodiment, an alumina base plate 31 and a heat generating layer 32 in the form of a line or a stripe provided by applying a heat resistance material such as silver palladium. In this embodiment, the linear or stripe heat generating layer 32 is supplied with electric power by the connection at the longitudinal opposite ends to produce heat along the entire length of the heat generating layer 32. The power supply is in the form of pulses having a period of 20 msec and with DC 100 V. A power supply control circuit is such that the width of the pulse is changed on the basis of the target temperature, the temperature detected by the temperature detecting element 33 and the energy radiation. The pulse width is controlled within the range of 0.5–5 msec, and the temperature of the heat generating layer 32 is instantaneously raised upon the pulse energization up to approximately 200°–300° C. Upstream of the fixing apparatus 20 with respect to the transfer material conveyance direction and at a position close to the fixing apparatus, a sheet sensor for detecting the leading and trailing edges of the sheet, although not shown. By the sheet detection signal of the sensor, the energization period of the heat generating layer 32 is limited within the period in which the sheet P is present in the fixing apparatus 20.

In this embodiment, the fixing film may be in the form of a non-endless film.

The unfixed toner image Ta is introduced into a nip formed between the fixing film 34 and the pressing roller 22 and is advanced while being pressed thereby. In the nip, the toner image Ta is heated by the heat from the heat generating layer 32 into a fused toner image Tb. Thereafter, by the time when the toner image reaches the separation roller 37, the fused toner image Tb is cooled and solidified into a solidified toner image Tc.

Figure 18:
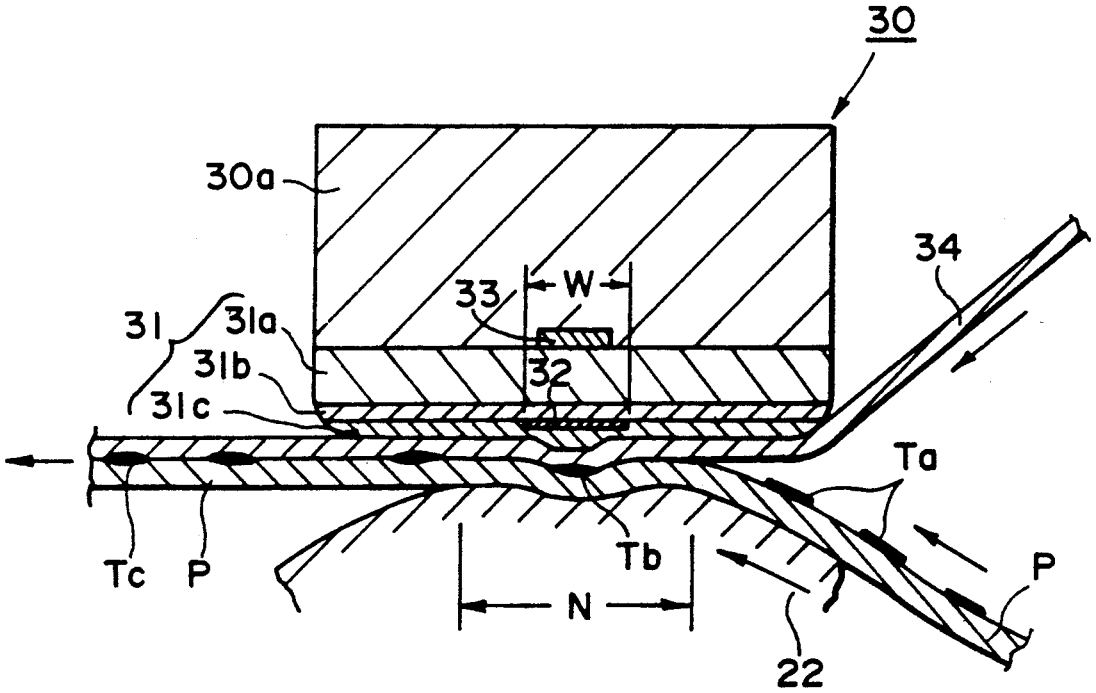
FIG. 18 is a cross-sectional view of a heating element used in the embodiment of FIG. 17.

Referring to FIG. 18, the heater 30 will be described. FIG. 18 is a cross-sectional view of the heater 30. A heater supporting member **30*a* is an elongated member having a rectangular cross-section extending in a lateral direction of the fixing film (the direction perpendicular to the travel direction of the fixing film 34) and is made of a high rigidity and low thermal conductivity material such as PPS, polyimide or Bakelite. The supporting member 30*a* is made of the heat resistive and low thermal conductivity material at least at the portion where it is contacted to the heater 31**, and of another material in the other portions.

A heater 31 is elongated and integrally fixed on the bottom surface of the supporting member **30*a*. The heater 31 in this embodiment comprises an alumina 10 base plate 31*a* (electrically insulative, and thermally high-conductive) having a length of 240 mm, a width of 10 mm and a thickness of 1.0 mm, a glazing layer 31*b* having a thickness of 100 microns and formed on the bottom surface of the base plate 31*a*, a heat generating resistance layer (heat generating layer) 32 made of silver-palladium (Ag/Pd) having a thickness of 10 microns in the form of a line or stripe provided by a screen printing method along the length of the glazing layer substantially at the middle thereof, and a heater surface protection layer 31*c* made of anti-wearing material such as glass having a thickness of 10 microns coated on the heat generating layer 32 and the glazing layer 31*b*. Designated by a reference numeral 33 is a temperature detecting element having a low thermal capacity such as bead thermister disposed within or in contact with the central portion (in a longitudinal direction) of the back side (top side) of the heater base plate 31**.

To the bottom surface of the heating element 31 of the heater 30, the top surface portion of the pressing roller 22 is urged through the fixing film 34 or through the fixing film 34 and the transfer sheet P (recording material) under a predetermined pressure.

Figure 19:
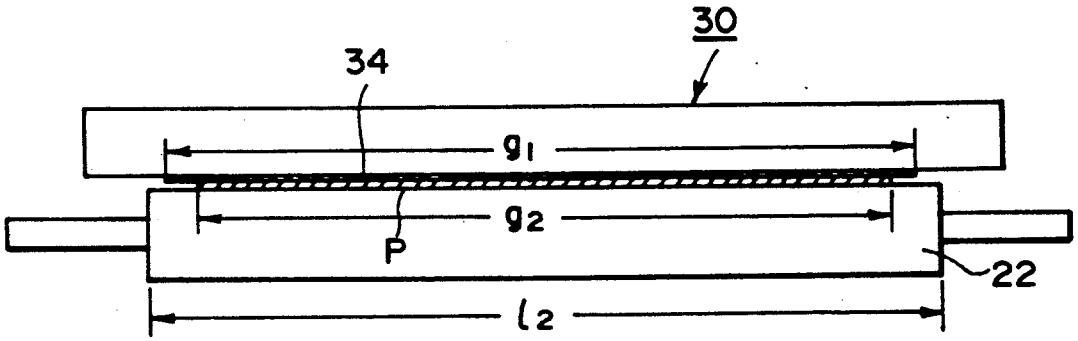
FIG. 19 is a front view of a heating element and a pressing roller used in FIG. 17.
Figure 20:
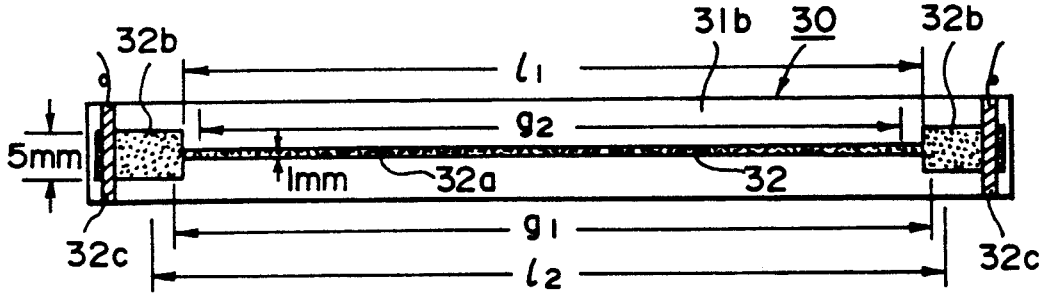
FIG. 20 is a top plan view of a pattern of the heat generating element.

FIG. 19 is a front view of the heater 30 and the pressing roller 22 urged thereto through the fixing film 34 and the transfer sheet P. FIG. 20 shows a surface pattern of the Ag/Pd heat generating resistance layer functioning as the heat generating element 32 formed on the glazing laser 31*b* of the heater 31 along the length thereof. The heat generating resistance layer has a linear or stripe effective heat generating portion 32*a* (the resistance per unit length is 1 ohm/cm) having a width of 1 mm, a thickness of 10 microns and a length of 230 mm ($l_1$), and a low heat generating portion 32*b* (low resistance portion having a resistance of 0.2 ohm/cm) having a width of 5 mm and a thickness of 10 microns. The low heat generating portion 32*b* are wider and are continuously extended, from each of the longitudinal ends of the effective heat generating portion 32*a*. To the two wide low heat generating portions 32*b*, power supply electrodes 32*c* are clamped.

When the electric power is supplied between the electrodes 32*c*, the heat generating element (Ag/Pd) 32 generates heat. The amounts of generated heat per unit length in the wide low heat generating portions 32*b* at the opposite ends are one fifth the amount of heat per unit length of the effective heat generating portion 32*a* since the width is five times, and therefore, the resistance is one fifth, although they have the same thickness (10 microns).

Mainly by the heat generation of the effective heat generating portion 32*a*, the temperature of the alumina base plate 31*a* is raised, and the temperature thereof is detected by the temperature detecting element 33 and is fed back to an unshown power supply control circuit. By the control of the power supply to the heat generating element 33, the temperature of the fixing nip corresponding to the effective heat generating portion 32*a* is maintained at a predetermined fixing temperature. In FIGS. 19 and 20, there are relationships of $l_2 > g_1 > l_1 > g_2$, where $l_2$ is a length of the pressing roller 22, $g_1$ is a width of the fixing film 34, and $g_2$ is a maximum width of the transfer material which can be used. Therefore, the portions adjacent to the opposite ends of the heat generating elements where the fixing film 34 is not urged by the pressing roller 22, correspond to the wide heat generating portions 32*b* having low heat generation.

Accordingly, it is avoided that the portions adjacent to the opposite ends of the heater not contacted to the fixing film or the pressing roller 22 is overheated due to the insufficient heat dissipation with the result of damage (fusing) of the heat generating layer corresponding to that portion.

The experiments by the inventors have shown that when the heater has the heat generating portions 32*b*, at the longitudinal opposite ends, having the same width, thickness and the resistance (1 ohm/cm) as those of the effective heat generating portion 32*a* (the opposite end portions are not contacted to the fixing film), the heat generating portions 32*b* not contacted to the fixing film are broken due to overheating, when the power is supplied continuously only for several minutes. On the other hand, the heater having the effective heat generating portion 32*a* and wide low heat generating portions (low resistance portion) 32*b* at the opposite ends (that is, having the resistance distribution wherein the resistance is high in the portion 32*a*, and the resistance is low in the portion 32*b*) has had no problem even after it is energized for several hundreds hours continuously.

The means for providing the resistance distribution in the direction of the length of the heat generating element 32 in this embodiment is to make the thickness constant and make the width different. The means may be different. For example, the width is made constant, but the thickness is changed, or the resistance of the material is changed along the length.

Figure 21:
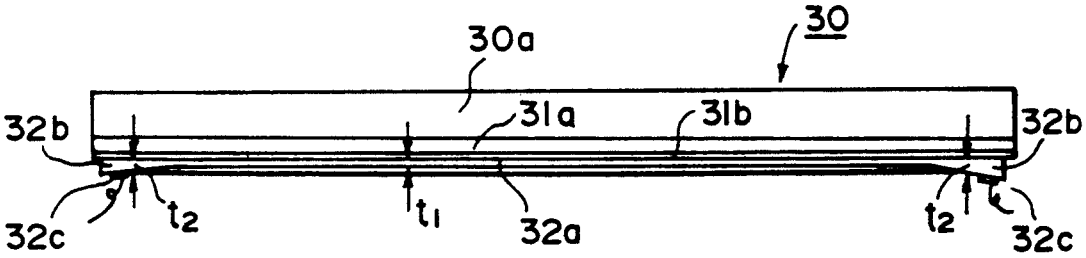
FIGS. 21 and 22 are other examples of the heat generating element.

Referring to FIG. 21, there is shown an embodiment wherein the longitudinal end portions of the heat generating element 32*b* where it is not contacted to the fixing film, have a thickness $t_2$ which is larger than the thickness $t_1$ of the effective heat generating portion 32*a*, whereas the widths of the portions 32*a* and 32*b* are the same. By doing so, the opposite end portions generate smaller amount of heat.

Figure 22:
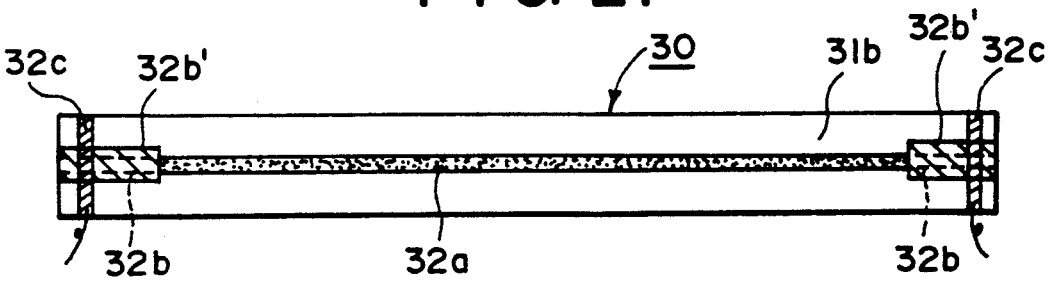

FIG. 22 shows an embodiment wherein the portions 32*b* are made of silver layer 32*b*' having a resistance lower than that of the silver-palladium.

It is important for the purpose of making the fixing property uniform along the length that the heater portion (the effective heat generating portion 32*a* of the heat generating element 32) corresponding to the width region $g_2$ through which the transfer sheet P passes during the fixing operation, provide a uniform temperature distribution in the longitudinal direction.

Figure 23:
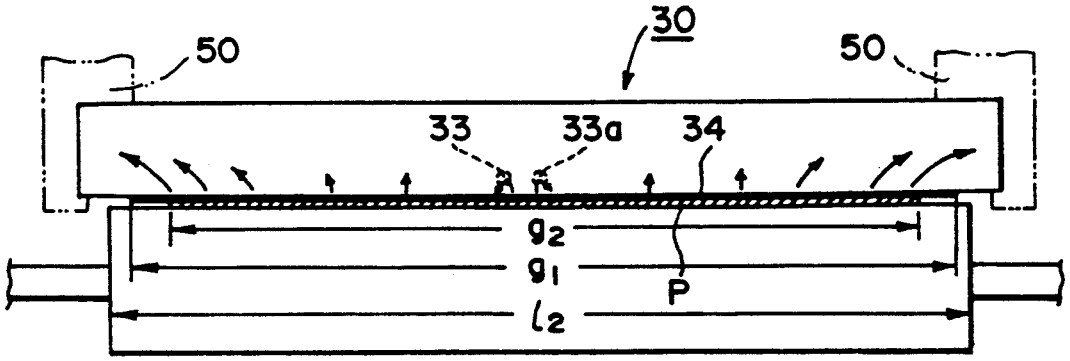
FIG. 23 illustrates heat radiation from a heating element.
Figure 24:
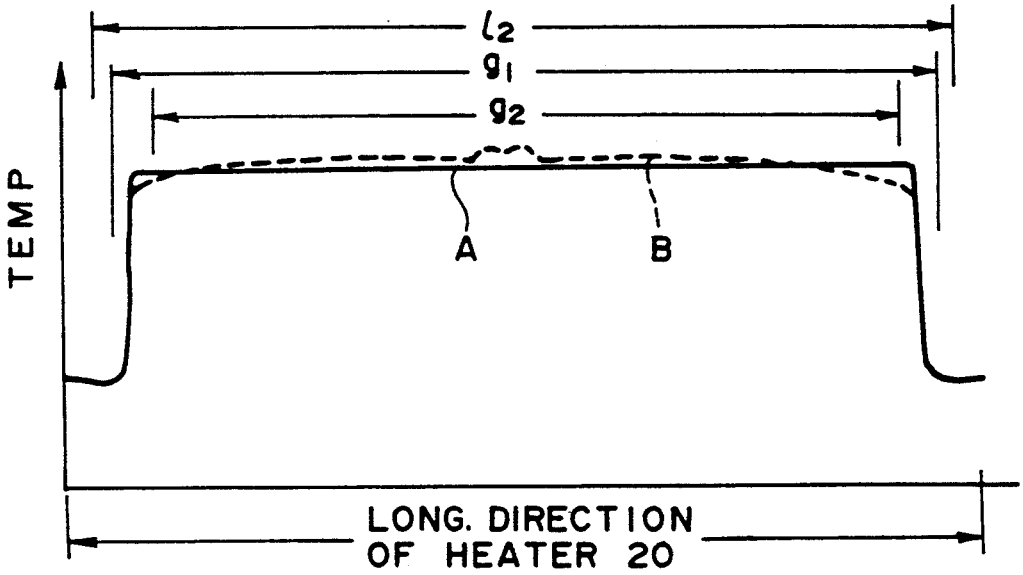
FIG. 24 is a graph of a temperature distribution along the length of the heat generating element.

Referring to FIGS. 23 and 24, however, the temperature distribution is not uniform due to the difference in the heat transfer or radiation in the longitudinal direction of the heater, as shown in FIG. 24 by broken line B, because the heat is easily dissipated through the supporting members 50 for the heat generating element adjacent to the opposite ends of the heater 30, as shown by arrows in FIG. 23, and also because the provision of the temperature detecting element 33 or the thermal fuse 33*a* at the center of the backside of the heater results in the different heat radiation property there.

Figure 25:
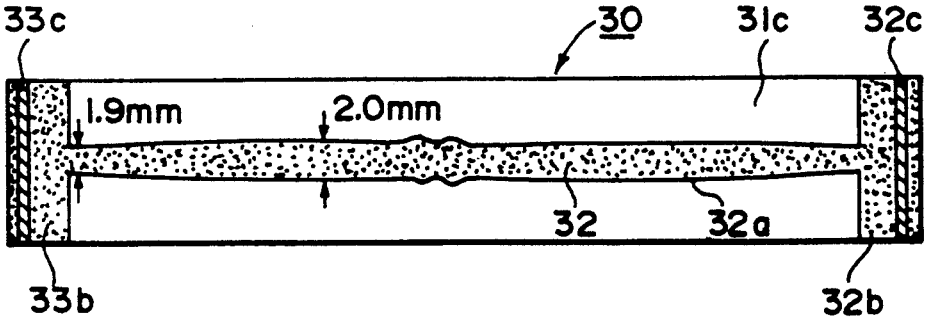
FIG. 25 is a top plan view of a pattern of the heat generating element according to another embodiment of the present invention wherein the temperature difference in the distribution is reduced.

In an embodiment of FIG. 25, the width of the heat generating layer 32 is changed in the longitudinal direction depending on the temperature distribution, that is, on the difference in the heat dissipation under the condition that the thickness is constant, by which the temperature distribution along the length of the heater in the region where the transfer sheet P passes is made uniform as shown by a solid line A in FIG. 24. By doing so, the temperature of the heater in the portion where the transfer sheet passes during the fixing operation has become uniform along the longitudinal direction, so that the uniform fixing property is provided.

The heat generating layer 32 of the heater 30 may be made of, in addition to the silver-palladium, nickel-chrome, tungsten, ruthenium oxide ($RuO_2$), $Ta_2N$, an electric resistance material mainly containing one or more of them, or a ceramic heater in the form of a heat generating surface. The temperature detecting element 33 may be in the form of a temperature detecting resistance film such as Pt film applied (by screen printing or the like) on the backside of the heater substrate 31*a* or on the glazing layer surface at the same side as the heat generating layer 32 in parallel with the heat generating layer 32 or in the form of lamination thereon. The heat generating layer 32 may be formed on the backside of the base plate 31*a*.

When the fixing film is in the form of a non-endless film as shown in FIG. 2, a replaceable rolled film can be employed, wherein when almost all of the fixing film is taken up on the take-up reel, a new roll of film is mounted (a wind-up and exchange type).

In this type, the thickness of the fixing film can be reduced substantially irrespective of the durability of the fixing film, so that the power consumption can be reduced. For example, the fixing film in this case may be made of a less expensive material such as PET (polyester) film which is treated for heat-durability having a thickness of 12.5 microns or lower, for example.

Alternatively, since the toner offset to the fixing film surface is not practically produced, the used fixing film taken up on the take-up shaft can be rewound on the feeding shaft, or the take-up shaft and the feeding shaft are interchanged to use the fixing film repeatedly, if the thermal deformation or thermal deterioration of the fixing film is not significant (a rewinding and repeatedly using type).

In this type, the fixing film is preferably made of a material exhibiting high heat-resistivity and mechanical strength, such as polyimide resin film having a thickness of 25 microns which is coated with a parting layer made of fluorine resin or the like having a good parting property to constitute a multi-layer film. A press-contact releasing mechanism is preferably provided to automatically release the press-contact between the heater and the pressing roller during the rewinding operation.

Where the fixing film is used repeatedly as in the rewinding type and an endless belt type, a felt pad may be provided to clean the film surface and to apply a slight amount of parting agent such as silicone oil by impregnating the pad with the oil, by which the surface of the film is maintained clean and maintained in good parting property. Where the fixing film is treated with insulating fluorine resin, electric charge is easy produced on the film, the electric charge disturbing the toner image. In that case, the fixing film may be rubbed with a discharging brush which is electrically grounded to discharge the film. On the contrary, the film may be electrically charged by applying a bias voltage to such a brush without grounding as long as the toner image is not disturbed. It is a possible measure against the image disturbance due to the electric charge to add carbon black or the like in the fixing film. The same means is applicable against the electric charge of the back-up roller. As a further alternative, anti-electrification agent may be applied or added.

In any of the endless belt type, the winding-up and exchanging type and the rewinding and repeatedly using type, the fixing film may be in the form of a detachably mountable cartridge which is detachably mountable to a predetermined position of the fixing apparatus to facilitate the exchange or the like of the fixing film.

The structure of the heater 20 and the power supply control to the heat generating layer are not limited to those described in the foregoing. The heat generating layer may be made of a chip array of ceramic material having PTC property or a thick resistance material. The power supply control is not limited to the pulsewise energization, but may be in the form of usual AC power supply.

Figure 26:
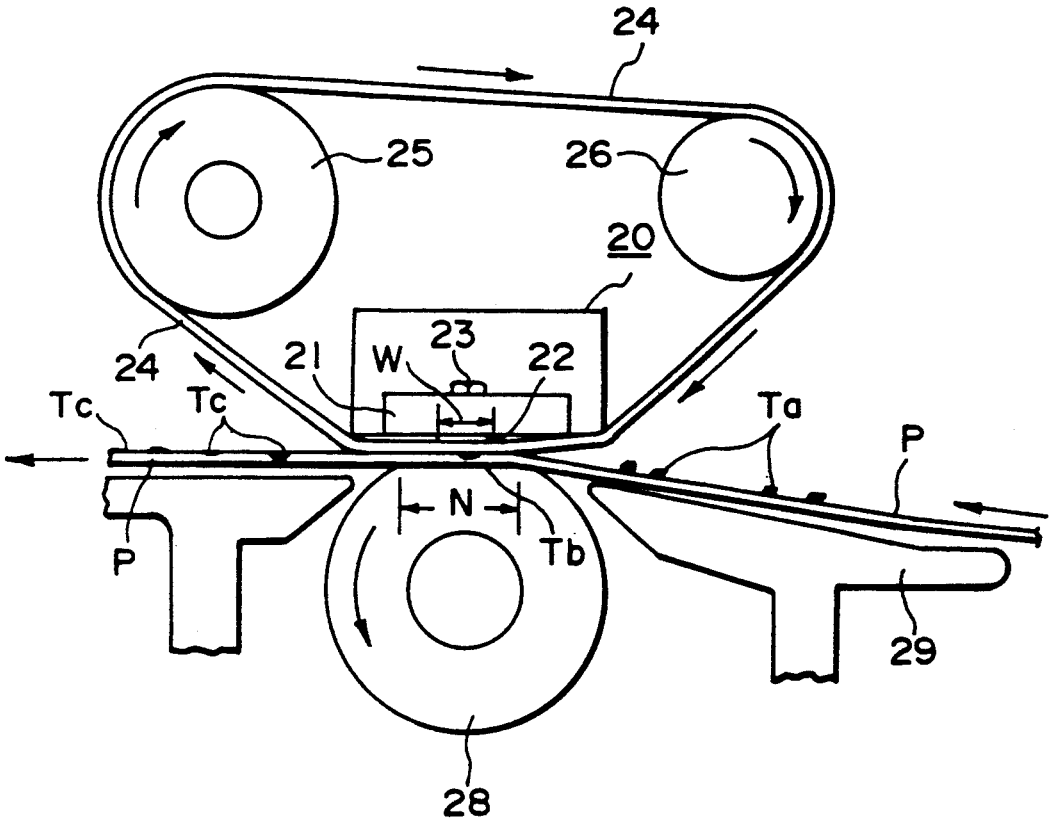
FIG. 26 is a sectional view of an image fixing apparatus according to a further embodiment of the present invention.

The toner heated and fused by the heating step may be cooled and solidified by the spontaneous heat radiation, or by a forced cooling using a blower or a heat radiation fins. In FIGS. 2 and 17, the toner is not necessarily sufficiently cooled or solidified at the position of the separating roller. If the toner shows the property in which it is sufficiently fused at the high temperature, it is possible as shown in FIG. 26 that after the toner is sufficiently fused at the high temperature in the heating step (fixing nip), the recording material (transfer sheet) P is immediately separated from the fixing film 24 surface without the cooling step after the heating step.

In the foregoing description, an image transfer type electrophotographic copying apparatus is taken, but the means and process for the image formation are not limited to those of this type. It may be of a type wherein a toner image is directly formed and carried on an electrofax sheet or an electrostatic recording sheet or the like, wherein the image is formed and recorded magnetically, wherein the toner image is formed with a heat-fusible toner on the recording medium by another image forming process and means. An examples of such an apparatus are heat-fixing type copying machine, laser beam printer, facsimile machine, a microfilm reader-printer, display device and recording device. The present invention is applicable to them.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus comprising:

a heater stationary in use, said heater having a linear heat generating layer extending in a direction transverse to a direction of movement of a recording material;

a film in sliding contact with said heater and movable together with the recording material, wherein a toner image on the recording material is heated by heat from said heater through said film;

wherein said heat generating layer has a resistance distribution provided by connecting different materials having different resistances; and wherein one of the resistance materials that has a smallest electric resistance is at a longitudinal end.

2. An image fixing apparatus comprising:

a heater stationary in use, said heater having a linear heat generating layer extending in a direction transverse to a direction of movement of a recording material;

a film in sliding contact with said heater and movable together with the recording material, wherein a toner image on the recording material is heated by heat from said heater through said film;

wherein said heat generating layer has a resistance distribution provided by connecting different materials having different resistances; and a pressing member for urging said film and the recording material toward said heat generating layer and having a pressing region which is shorter than a length of said heat generating layer, wherein said heat generating layer has a smaller resistance per unit length in a non-pressing region than in the pressing region.

3. An image fixing apparatus comprising:

a heater stationary in use, said heater having a linear heat generating layer extending in a direction transverse to a direction of movement of a recording material;

a film in sliding contact with said heater and movable together with the recording material, wherein a toner image on the recording material is heated by heat from said heater through said film;

wherein said heat generating layer has a resistance distribution provided by connecting different materials having different resistances; and wherein said film slides on said heater during a fixing operation, and wherein said heat generating layer has a length larger than a width of said film, and said heat generating layer has a smaller electric resistance in a portion that does not contact said film than a portion where it does contact said film.

4. An apparatus according to claims 1, 2 and 3, wherein said heat generating layer and the toner image contact without an air layer therebetween.

5. An apparatus according to claim 4, further comprising a pressing member for urging said film and said recording material toward said heater.

6. An image fixing apparatus, comprising:

a heater stationary in use, said heater having a linear heat generating layer extending in a direction transverse to a direction of movement of a recording material;

a film in sliding-contact with said heater and movable together with the recording material, wherein a toner image on the recording material is heated by heat from said heater through said film;

wherein said heat generating layer has a resistance distribution provided by varied width in a longitudinal direction thereof.

7. An apparatus according to claim 6, wherein a longitudinal end portion of said heat generating layer has a width larger than that in the central portion thereof.

8. An apparatus according to claim 7, further comprising a pressing member for urging said film and the recording material toward said heat generating layer and having a pressing region which is shorter than a length of said heat generating layer, wherein said heat generating layer has a larger width in a non-pressing region than in the pressing region.

9. An apparatus according to claim 6, wherein an end portion of said heat generating layer has a width larger than that in the central portion thereof.

10. An apparatus according to claim 6, wherein said heat generating layer is made of the same material throughout its length.

11. An apparatus according to claim 6, wherein said heating generating layer and the toner image are contacted without an air layer therebetween.

12. An apparatus according to claim 6, further comprising a pressing member for urging said film and recording material toward said heater.

* * * * *

UNITED STATES PATENT AND TRADEMARK OFFICE

CERTIFICATE OF CORRECTION

PATENT NO. 5,241,155

DATED August 31, 1993

INVENTOR(S) Shokyo KOH, et al.

It is certified that error appears in the above-indentified patent and that said Letters Patent is hereby corrected as shown below:

On the Cover Page

[75] under Kimura: "Kanagawa;" should read --Yokohama;--.

Column 8

Line 33, "detec-" should read --direc- --.

Column 10

Line 10, "and" should be deleted.
Line 11, "therefore," should be deleted.
Line 27, "h[at" should read --heat--.
Line 45, "but" should be deleted.

Column 11

Line 8, "comprises" should read --comprise--.
Line 25, "light" should read --right--.
Line 37, "image Ia" should read --image Ta--.
Line 44, "film 24" should read --film 34--.

Column 12

Line 45, "alumina 10" should read --alumina--.

UNITED STATES PATENT AND TRADEMARK OFFICE

CERTIFICATE OF CORRECTION

PATENT NO. : 5,241,155

DATED : August 31, 1993

INVENTOR(S) : Shokyo KOH, et al.

It is certified that error appears in the above-indentified patent and that said Letters Patent is hereby corrected as shown below:

Column 16

Line 13, "An examples" should read --Examples--.

Signed and Sealed this

Twenty-sixth Day of April, 1994

Bruce Lehman

*Attest:*

BRUCE LEHMAN

*Attesting Officer*

*Commissioner of Patents and Trademarks*